US012054866B2

(12) United States Patent
Shibata et al.

(10) Patent No.: US 12,054,866 B2
(45) Date of Patent: Aug. 6, 2024

(54) SEWING MACHINE AND NON-TRANSITORY COMPUTER READABLE STORAGE MEDIUM

(71) Applicant: BROTHER KOGYO KABUSHIKI KAISHA, Nagoya (JP)

(72) Inventors: Kazuki Shibata, Nagoya (JP); Yoshihiro Minematsu, Nagoya (JP); Satomi Yamamoto, Okazaki (JP); Sayaka Kurihara, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 81 days.

(21) Appl. No.: 17/822,963

(22) Filed: Aug. 29, 2022

(65) Prior Publication Data

US 2022/0411978 A1 Dec. 29, 2022

Related U.S. Application Data

(63) Continuation of application No. PCT/JP2020/014763, filed on Mar. 31, 2020.

(51) Int. Cl.
*D05B 19/08* (2006.01)
*D05B 19/12* (2006.01)
(Continued)

(52) U.S. Cl.
CPC ..... *D05B 19/08* (2013.01); *D05B 19/12* (2013.01); *D05C 5/02* (2013.01); *D05C 5/04* (2013.01)

(58) Field of Classification Search
CPC ..... D05B 19/08; D05B 19/12; D05C 5/04; D05C 5/02
See application file for complete search history.

(56) References Cited

U.S. PATENT DOCUMENTS 10,626,533 B2 * 4/2020 Yamanashi ..... D05B 19/08
10,883,209 B2 * 1/2021 Kongo ..... D05B 19/08
(Continued)

FOREIGN PATENT DOCUMENTS

JP H09-70487 A 3/1997
JP H10-328455 A 12/1998
(Continued)

OTHER PUBLICATIONS

Jul. 7, 2020 Search Report issued in International Patent Application No. PCT/JP2020/014763.
(Continued)

*Primary Examiner* — Danny Worrell
(74) *Attorney, Agent, or Firm* — Oliff PLC

(57) ABSTRACT

A memory of a sewing machine stores a plurality of notification conditions for notifying an information processing device of an extent of progress of sewing of the embroidery pattern. The notification conditions include a first notification condition for notifying that the extent of progress is a first extent and a second notification condition for notifying that the extent of progress is a second extent. The sewing machine transmits, to the information processing device, first extent information indicating the first extent, when the sewing machine determines that the first notification condition is satisfied. The sewing machine transmits, to the information processing device, the second extent information indicating the second extent, when the sewing machine determines that the second notification condition is satisfied.

13 Claims, 18 Drawing Sheets

(51) Int. Cl.
*D05C 5/02* (2006.01)
*D05C 5/04* (2006.01)

(56) References Cited

U.S. PATENT DOCUMENTS

| | | | | |
|---|---|---|---|---|
| 2001/0004717 | A1 | 6/2001 | Zhang et al. | |
| 2013/0035780 | A1* | 2/2013 | Abe | D05C 5/04 112/102.5 |
| 2015/0040810 | A1 | 2/2015 | Kongo et al. | |
| 2019/0024276 | A1* | 1/2019 | Nguyen | G05B 19/4097 |
| 2019/0062971 | A1* | 2/2019 | Kamihira | D05B 19/10 |
| 2020/0318271 | A1* | 10/2020 | Park | D05B 21/002 |
| 2022/0411978 | A1* | 12/2022 | Shibata | D05C 5/02 |

FOREIGN PATENT DOCUMENTS

| | | | | |
|---|---|---|---|---|
| JP | 2001-170384 | A | 6/2001 | |
| JP | 2009-142609 | A | 7/2009 | |
| JP | 2011-182262 | A | 9/2011 | |
| JP | 2015-33468 | A | 2/2015 | |
| JP | 2018-55493 | A | 4/2018 | |
| WO | WO-2021019834 | A1 * | 2/2021 | D05B 19/006 |

OTHER PUBLICATIONS

Sep. 29, 2022 International Preliminary Report on Patentability issued in International Patent Application No. PCT/JP2020/014763.

* cited by examiner

SEWING MACHINE AND NON-TRANSITORY COMPUTER READABLE STORAGE MEDIUM

REFERENCE TO RELATED APPLICATION

This application is a Continuation Applications of International Application No. PCT/JP2020/014763, filed on Mar. 31, 2020. The entire content of the priority application is incorporated herein by reference.

BACKGROUND ART

A sewing status verification system is known that includes a sewing machine and an embroidery status verification device. An embroidery status verification application is installed in the embroidery status verification device. The embroidery status verification application receives, from the sewing machine, status data indicating a status of a pattern currently being sewn, and draws image data on a display portion. The image data includes an embroidery completion drawing, an embroidery status such as a number of stitches required to complete the embroidery, a thread replacement event, and the like.

In the above-described system, the status data is transmitted to the embroidery status verification device from the sewing machine at a timing at which it is necessary to replace the thread in the sewing machine. The embroidery status verification device receives the status data and displays the thread replacement event on the display portion. For example, the user recognizes that the thread replacement is necessary to continue the sewing by the sewing machine as a result of the thread replacement event being displayed on the display portion of the embroidery status verification device.

DESCRIPTION

It is necessary for the sewing machine to stop the sewing during a period from when the thread replacement becomes necessary in the sewing machine to when the thread is replaced by the user and it is possible to re-start the sewing. In a case where the user recognizes the thread replacement event displayed when the thread replacement becomes necessary, and after that, the user starts preparations to replace the thread, a time period during which the sewing by the sewing machine is stopped becomes longer, compared to a case in which the thread replacement is carried out at a timing as soon as the thread replacement is necessary. Thus, as a result, a time period until the sewing is complete becomes longer.

Regardless of the thread replacement event, for example, also in the case of an event that is displayed for the sewing completion of a first embroidery pattern, when a second embroidery pattern is continuously sewn, if preparation for the sewing of the second embroidery pattern is started after the sewing of the first embroidery pattern is complete, a time period during which the sewing by the sewing machine is stopped becomes longer, compared to a case in which the sewing of the second embroidery pattern is started at a timing immediately after the completion of the sewing of the first embroidery pattern.

An object of the present disclosure is to provide a sewing machine and a non-transitory computer readable storage medium with which, by performing notification in advance of a timing at which sewing is to be stopped, a user can make preparations for operations required as a result of the stopping of the sewing.

Various embodiments herein provide a sewing machine includes a sewing portion include a sewing portion, a communication portion, a processor, and a memory. The sewing portion is configured to sew an embroidery pattern based on sewing data. The communication portion performs communication with an information processing device. The memory is configured to store a plurality of notification conditions for notifying the information processing device of an extent of progress of sewing of the embroidery pattern, the notification conditions including a first notification condition for notifying that the extent of progress is a first extent and a second notification condition for notifying that the extent of progress is a second extent, and computer readable instructions that, when executed by the processor, instruct the processor to perform processes. The instructions include first acquisition processing, second acquisition processing, first determination processing, first transmission processing, second determination processing, and second transmission processing. The first acquisition processing acquires the sewing data. The second acquisition processing acquires the extent of progress, based on sewing information specified by the sewing data acquired by the first acquisition processing. The first determination processing determines whether the extent of progress acquired by the second acquisition processing satisfies the first notification condition stored in the memory. The first transmission processing controls the communication portion and transmits, to the information processing device, first extent information indicating the first extent, when the first determination processing determines that the first notification condition is satisfied. The second determination processing determines whether the extent of progress acquired by the second acquisition processing satisfies the second notification condition stored in the memory. The second transmission processing controls the communication portion and transmits, to the information processing device, second extent information indicating the second extent, when the second determination processing determines that the second notification condition is satisfied.

Various embodiments also provide a non-transitory computer readable storage medium storing computer readable instructions that, when executed by a processor, cause the processor to perform processes. The instructions include acquisition processing, first determination processing, first output processing, second determination processing, and second output processing. The acquisition processing acquires an extent of progress of sewing of an embroidery pattern. The first determination processing determines whether the first notification condition for notifying that the extent of progress acquired by the acquisition processing is a first extent is satisfied. The first output processing outputs first extent information indicating the first extent, when the first determination processing determines that the first notification condition is satisfied. The second determination processing determines whether a second notification condition for notifying that the extent of progress acquired by the acquisition processing is a second extent is satisfied. The second output processing outputs second extent information indicating the second extent, when the second determination processing determines that the second notification condition is satisfied.

Various embodiments also provide a non-transitory computer readable storage medium storing computer readable instructions that, when executed by a processor, cause the processor to perform processes. The instructions include first transmission processing, first determination processing, storage processing, prediction processing, second determination processing, first output processing, third determination processing, and second output processing. The first transmission processing transmits, to a sewing machine, a transmission request requesting transmission of an extent of progress of sewing of an embroidery pattern. The first determination processing determines whether the extent of progress transmitted from the sewing machine in response to the transmission request transmitted by the first transmission processing is received. The storage processing stores the received extent of progress in a memory, when the first determination processing determines that the extent of progress is received. The prediction processing predicts, when the first determination processing determines that the extent of progress is not received, the extent of progress based on the extent of progress stored in the memory and an elapsed time period from a time point of storing the extent of progress in the memory. The second determination processing determines whether a first notification condition for notifying that the extent of progress predicted by the prediction processing is a first extent is satisfied. The first output processing outputs first extent information indicating the first extent, when the second determination processing determines that the first notification condition is satisfied. The third determination processing determines whether a second notification condition for notifying that the extent of progress predicted by the processing is a second extent is satisfied. The second output processing outputs second extent information indicating the second extent, when the third determination processing determines that the second notification condition is satisfied.

For example, the sewing machine sets, as the first extent, the extent of progress of the sewing at a timing before a timing at which the sewing is to be stopped, and sets, as a second extent, the extent of progress of the sewing that has progressed further than the extent of progress specified by the first extent. In this case, the sewing machine can transmit the first extent information to the information processing device at a timing before the timing of stopping the sewing, and can transmit the second extent information to the information processing device at a subsequent timing. Thus, the sewing machine can notify the information processing device in advance of the timing at which the sewing is to be stopped. As a result, a user that recognizes this notification can make preparations in advance for operations required as a result of the stopping of the sewing. Thus, the sewing machine can shorten a time period required until completion of sewing of an embroidery pattern.

Embodiments embodying the present disclosure will be described in order, with reference to the drawings. The referenced drawings are used to illustrate technological features that can be adopted by the present disclosure, and configurations and the like of devices described herein are not intended to limit the present disclosure to those configurations and the like, and are simply explanatory examples.

Configuration of Notification System 1

Figure 1A:
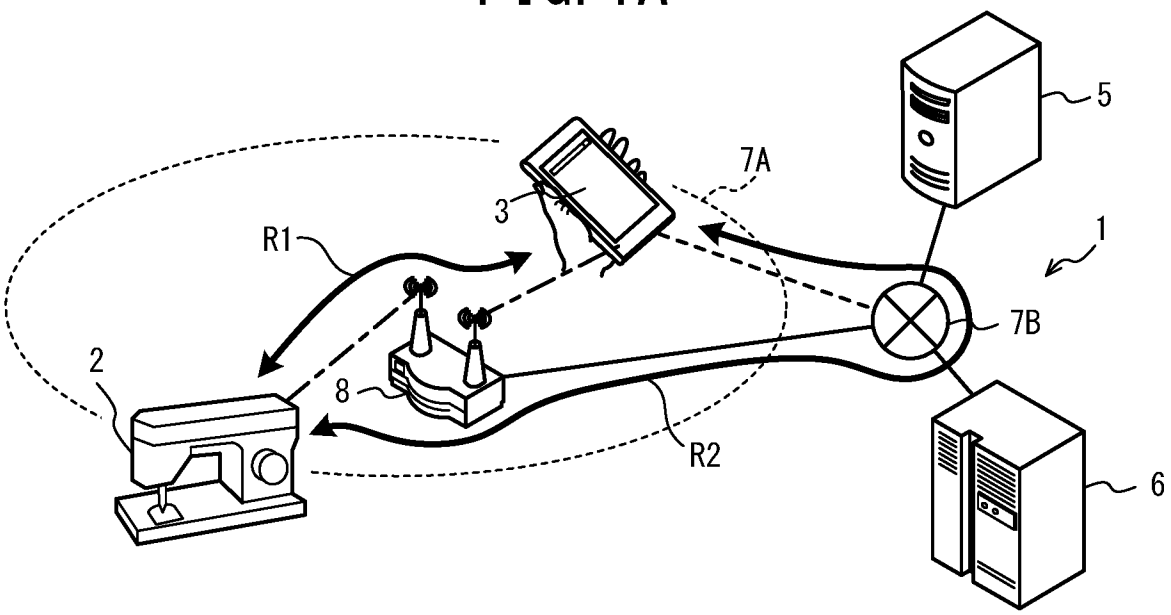
FIG. 1A is a system configuration diagram of a notification system.

As shown in FIG. 1A, a notification system 1 includes a sewing machine 2, an information processing device 3, and servers 5 and 6. The notification system 1 notifies a user, via the information processing device 3, of an extent of progress when an embroidery pattern is sewn by the sewing machine 2 using threads of one or a plurality of colors. The following may be used as the extent of progress: a number of sewn stitches; a ratio of a portion for which sewing is complete, of the embroidery pattern as a whole; a remaining time period until completion of the sewing by each of the colors, when the embroidery pattern is sewn using the threads of the plurality of colors; a remaining time period until completion of the sewing of the embroidery pattern as a whole, and the like. Hereinafter, a specific description will be made using an example of a case in which notification is performed by the information processing device 3, using the remaining time period until completion of the sewing by each of the colors as the extent of progress. Note that when the threads of the plurality of colors are used in the sewing of the embroidery pattern, the remaining time period indicates the remaining time period until the completion of the sewing by each of the threads of the plurality of colors for each of the thread colors.

Using an upper thread of a thread spool housed in a housing portion (not shown in the drawings), and a lower thread of a bobbin housed in a shuttle (not shown in the drawings), the sewing machine 2 sews the embroidery pattern on a cloth fixed to an embroidery frame (not shown in the drawings). The information processing device 3 is a known smartphone. The information processing device 3 performs notification to the user by displaying, on an LCD 308, the extent of progress of the sewing of the embroidery pattern by the sewing machine 2. When a notification application installed in an operating system (OS) of the information processing device 3 is activated, and a state is obtained in which the user can perform an operation (an active state), the extent of progress is notified by the running application displaying the extent of progress on the LCD 308. Hereinafter, the application being executed in this type of state will be referred to as "running in the foreground." Normally, the application that is running in the foreground is displayed furthest to the front on the LCD 308. On the other hand, when the application is activated but is in a state in which the operation by the user is not possible (a non-active state), the extent of progress is notified by a message indicating the extent of progress being displayed on the LCD 308 by a push notification function installed in the OS. Hereinafter, the application being executed in this type of state will be referred to as "running in the background."

The OS includes a sleep function. The sleep function is one of energy saving functions. When an operation is not performed on the information processing device 3 for a certain period of time, the OS transitions to a sleep state. When the OS is in the sleep state, the display of the LCD 308 is turned off, and the functions of the application are stopped. However, even when the OS is in the sleep state, when a push notification command is received from a server, the sleep state is released, and the message indicating the extent of progress can be displayed on the LCD 308.

The server 6 is a push notification distribution server. The server 6 distributes, to the information processing device 3, a command (hereinafter referred to as a "notification instruction") to cause the push notification to be executed in the information processing device 3. The server 5 is a management server. The server 5 receives a request from the sewing machine 2, and asks the server 6 to distribute the notification instruction. The push notification is a function by which, when an information update relating to the application installed in the OS of the information processing device 3 has occurred, or when the information processing device 3 receives information relating to the application from the server 6, the OS displays that fact on the LCD 308.

The sewing machine 2 and the information processing device 3 are connected to a LAN 7A via an access point 8. Using the access point 8, the sewing machine 2 and the information processing device 3 can communicate with each other via the LAN 7A. Further, the information processing device 3, the servers 5 and 6, and the access point 8 are connected to a public network 7B. The sewing machine 2 is connected to the public network 7B via the access point 8. The sewing machine 2, the information processing device 3, and the servers 5 and 6 can communicate with each other via the public network 7B. Communication performed between the sewing machine 2 and the information processing device 3 for notifying the user of the extent of progress of the sewing machine 2 is sometimes performed via the LAN 7A without passing through the public network 7B (a path R1), and is sometimes performed via the LAN 7A and the public network 7B by passing through the servers 5 and 6 (a path R2).

Electrical Configuration

Figure 1B:
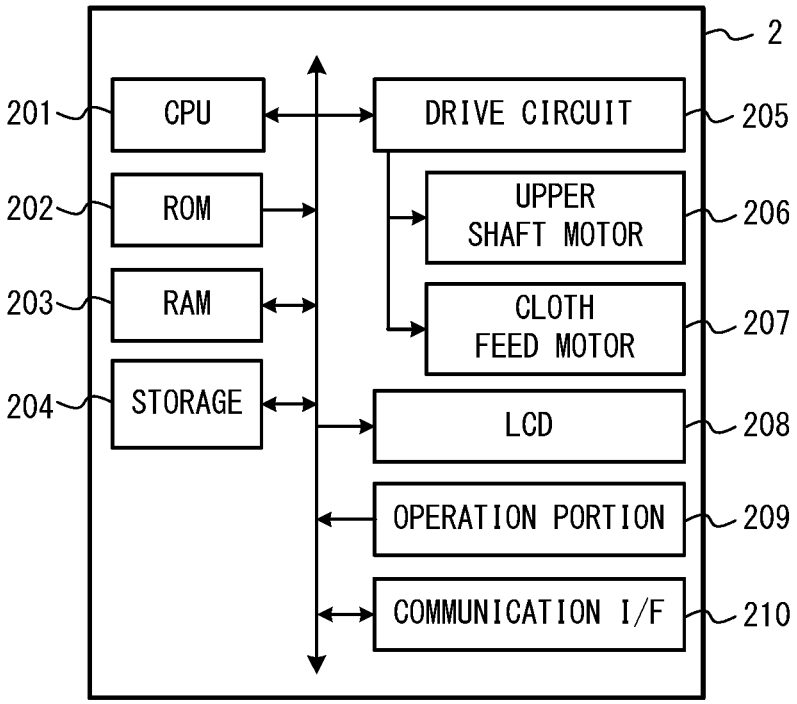
FIG. 1B is a block diagram showing an electrical configuration of a sewing machine.

As shown in FIG. 1B, the sewing machine 2 is provided with a CPU 201 that performs control of the sewing machine 2. The CPU 201 is electrically connected to a ROM 202, a RAM 203, a storage 204, a drive circuit 205, a liquid crystal display device (LCD) 208, an operation portion 209, and a communication I/F 210, via an interface circuit (not shown in the drawings). The ROM 202 stores a boot program and the like. The RAM 203 stores a timer, a counter, flag data, and temporary data. The storage 204 is configured by a storage medium, such as a flash memory. The storage 204 stores programs of processing performed by the CPU 201, sewing data, and a plurality of notification conditions.

The sewing data includes needle drop data indicating, in a sewing order, coordinates of needle drop points for forming stitches configuring the embroidery pattern. Further, when the threads of the plurality of colors are used when sewing the embroidery pattern, the sewing data includes the needle drop data and color data. The color data indicates an order of the color of thread used when performing the sewing. The needle drop data specifies the coordinates of the needle drop points per color when performing the sewing using the threads of each of the plurality of colors.

Further, the sewing data sometimes includes a re-attachment flag. The re-attachment flag indicates that it is necessary to re-attach the cloth to the embroidery frame. The re-attachment flag is set on the basis of a size of the embroidery pattern to be sewn, and a size of a sewable region defined by the embroidery frame. This will be described in more detail below. When sewing the embroidery pattern that is larger than the sewable region, after sewing a portion of the embroidery pattern, the sewing machine 2 can sew another portion of the embroidery pattern so as to be joined up with the portion of the embroidery pattern that has already been sewn, on the cloth whose fixing position with respect to the embroidery frame has been changed by the user. When sewing the embroidery pattern larger than the sewable region, the re-attachment flag is set for changing the fixing position of the cloth with respect to the embroidery frame.

In addition, the sewing data sometimes includes a replacement flag. The replacement flag is set when the sewing using a color among the plurality of colors is complete, and the thread is to be replaced with the thread of another color.

The plurality of notification conditions indicate conditions when the remaining time period until the completion of the sewing of the embroidery pattern is notified to the information processing device 3 as the extent of progress. Here, when the threads of the plurality of colors are used for the sewing in the sewing of the embroidery pattern, the "remaining time period until the completion of the sewing of the embroidery pattern" indicates the remaining time period until the completion of the sewing by each of the threads of the plurality of colors. Furthermore, when the size of the embroidery pattern is larger than the size of the sewable region, the "remaining time period until the completion of the sewing of the embroidery pattern" indicates the remaining time period until the completion of the sewing of the portion of the embroidery pattern before the fixing position of the cloth with respect to the embroidery frame is changed. Similarly, when the size of the embroidery pattern is larger than the size of the sewable region, the "remaining time period until the completion of the sewing of the embroidery pattern" indicates the remaining time period until the completion of the sewing of the other portion of the embroidery pattern after the fixing position of the cloth with respect to the embroidery frame is changed.

The plurality of notification conditions include at least a first notification condition and a second notification condition. The first notification condition is for performing notification that the remaining time period until the completion of the sewing is a first remaining time period. The first remaining time period is three minutes, for example. The second notification condition is for performing notification that the remaining time period until the completion of the sewing is a second remaining time period that has advanced from the first remaining time period. The second remaining time period is zero minutes, for example. In other words, the second notification condition is for performing notification that the sewing of the embroidery pattern is complete.

Note that, in the above description, the number of the notification conditions is not limited to two, and may be three or more. The first remaining time period (3 minutes) and the second remaining time period (zero minutes) are examples, and may be other values. It is sufficient that the second remaining time period be a value that has advanced from the first remaining time period, and the second remaining time period may be a value larger than zero minutes, for example. In this case, the notification may be performed before the completion of the sewing of the embroidery pattern.

The drive circuit 205 drives an upper shaft motor 206 and a cloth feed motor 207 in accordance with a signal output by the CPU 201 on the basis of the sewing data stored in the storage 204. The upper shaft motor 206 causes a sewing needle that is connected to a needle bar (not shown in the drawings) to reciprocate in the up-down direction. The cloth feed motor 207 moves a cloth feed mechanism (not shown in the drawings) in the horizontal direction. By simultaneously driving the upper shaft motor 206 and the cloth feed motor 207, the sewing machine 2 can perform the sewing of the embroidery pattern on the cloth fixed to the embroidery frame. The LCD 208 can display various information relating to the sewing. The operation portion 209 includes a pedal, operation keys, a touch panel, and the like that are not shown in the drawings. The communication I/F 210 is a communication module for connecting to the LAN 7A and the public network 7B via the access point 8. The communication I/F 210 can perform communication with the information processing device 3 via the path R1 using a communication function for performing the communication with the information processing device 3 via the LAN 7A. The communication I/F 210 can perform communication with the information processing device 3 via the path R2 using a communication function for performing the communication with the information processing device 3 via the public network 7B.

Figure 1C:
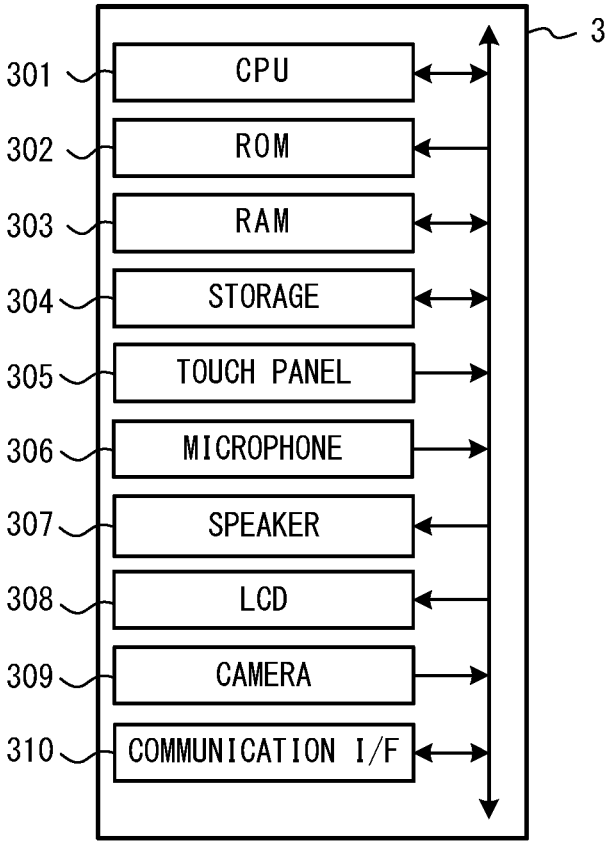
FIG. 1C is a block diagram showing an electrical configuration of an information processing device.

As shown in FIG. 1C, the information processing device 3 is provided with a CPU 301 that performs control of the information processing device 3. The CPU 301 is electrically connected to a ROM 302, a RAM 303, a storage 304, a touch panel 305, a microphone 306, a speaker 307, the LCD 308, a camera 309, and a communication I/F 310, via an interface circuit (not shown in the drawings). The ROM 302 stores a boot program and the like. The RAM 303 stores a timer, a counter, flag data, and temporary data. The storage 304 is configured by a storage medium, such as a flash memory. The storage 304 stores programs of processing performed by the CPU 301. Further, the storage 304 stores an OS, and various programs, such as applications and the like, executed on the OS.

The touch panel 305 detects a position of a touch operation. The microphone 306 converts ambient sound into audio data and outputs the audio data. The speaker 307 outputs audio on the basis of the input audio data. The LCD 308 displays an image on the basis of image data. The camera 309 generates a captured image obtained by capturing an imaging range, and outputs the captured image. The communication I/F 310 includes a communication module for connecting to the LAN 7A and the public network 7B via the access point 8, and a communication module for directly connecting to the public network 7B.

Figure 1D:
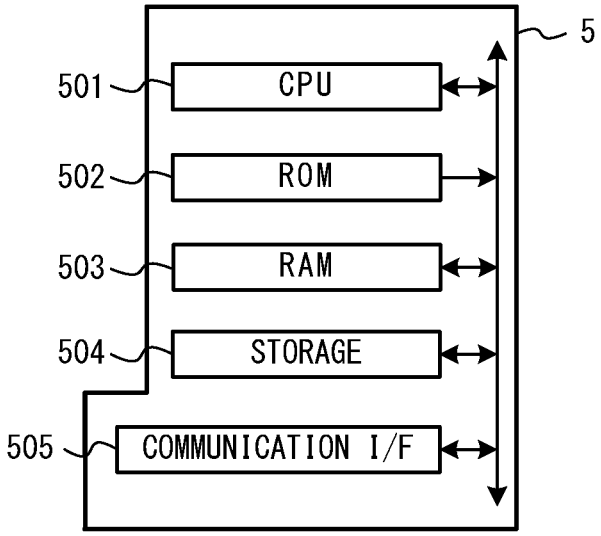
FIG. 1D is a block diagram showing an electrical configuration of a server.

As shown in FIG. 1D, the server 5 is provided with a CPU 501 that performs control of the server 5. The CPU 501 is electrically connected to a ROM 502, a RAM 503, a storage 504, and a communication I/F 505, via an interface circuit (not shown in the drawings). The ROM 502 stores a boot program and the like. The RAM 503 stores a timer, a counter, flag data, and temporary data. The storage 504 is configured by a storage medium, such as a flash memory. The storage 504 stores programs of processing performed by the CPU 501. Further, the storage 504 stores ID that identifies the information processing device 3. The ID is generated in the server 6, and registered in the storage 504 of the server 5. The communication I/F 505 is a communication module for connecting to the public network 7B.

Figure 1E:
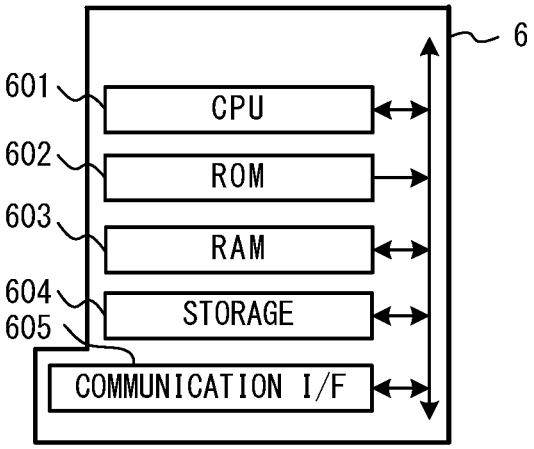
FIG. 1E is a block diagram showing an electrical configuration of a server.

As shown in FIG. 1E, the server 6 is provided with a CPU 601 that performs control of the server 6. The CPU 601 is electrically connected to a ROM 602, a RAM 603, a storage 604, and a communication I/F 605, via an interface circuit (not shown in the drawings). The ROM 602 stores a boot program and the like. The RAM 603 stores a timer, a counter, flag data, and temporary data. The storage 604 is configured by a storage medium, such as a flash memory. The storage 604 stores programs of processing performed by the CPU 601. The communication I/F 605 is a communication module for connecting to the public network 7B.

In the following description, when the CPU 201 of the sewing machine 2 performs various processing, this will be referred to as "the sewing machine 2 performs . . . ". When the CPU 301 of the information processing device 3 performs various processing, this will be referred to as "the information processing device 3 performs . . . ". When the CPU 501 of the server 5 performs various processing, this will be referred to as "the server 5 performs . . . ". When the CPU 601 of the server 6 performs various processing, this will be referred to as "the server 6 performs . . . ".

Main Processing

Main processing performed by the sewing machine 2 will be described with reference to FIG. 2 to FIG. 4. When a start command to start the sewing of the embroidery pattern on the basis of the sewing data stored in the storage 204 is input via the operation portion 209, the sewing machine 2 starts the main processing by reading out the programs stored in the storage 204 and executing the read programs. Hereinafter, a specific description will be given of an example of a case in which the sewing is performed of the whole embroidery pattern using, in order, threads of two types of color (a first color and a second color). In this case, in the color data included in the sewing data, the first color is specified as the color to be used first in order in the sewing, and the second color is specified as the color to be used last in order in the sewing.

Furthermore, the size of the embroidery pattern to be sewn on the basis of the sewing data stored in the storage 204 is larger than the sewable region defined by the embroidery frame. Thus, after a first portion, which is a portion of the embroidery pattern, has been sewn using the thread of the second color, the fixing position of the cloth with respect to the embroidery frame is changed by the user, and subsequently, the second portion, which is a remaining portion of the embroidery pattern, is sewn using the thread of the second color. In other words, the re-attachment flag is set in the sewing data to stop the sewing in order for the user to re-attach the cloth with respect to the embroidery frame after the first portion is sewn using the thread of the second color. Thus, first needle drop data for sewing using the thread of the first color, second needle drop data for sewing the first portion of the embroidery pattern using the thread of the second color, and third needle drop data for sewing the second portion of the embroidery pattern using the thread of the second color are included in the sewing data, in the sewing order (in order of the first needle drop data, the second needle drop data, and the third needle drop data).

Note that each of the needle drop data specifies the coordinates of the plurality of needle drop points. Further, subsequent to the first needle drop data for the sewing using the thread of the first color, the replacement flag for replacing the thread with the thread of the other color is further included in the sewing data, and, subsequent to the second needle drop data for sewing the first portion of the embroidery pattern using the thread of the second color, the re-attachment flag for re-attaching the cloth with respect to the embroidery frame is further included in the sewing data. The upper thread of the first color that is used first when sewing the embroidery pattern is attached to the sewing machine 2. The upper thread attached to the sewing machine 2 will be referred to as a "sewing thread in use."

The sewing machine 2 sets to "0" a first notification flag and an immediately after flag, which are stored in the RAM 203, and initializes the flags (step S11). The first notification flag indicates whether or not first notification processing has been performed at step S41 to be described later (refer to FIG. 3). When the first notification flag is set to "0", this indicates that the first notification processing has not been performed. When the first notification flag is set to "1", this indicates that the first notification processing has been performed. The immediately after flag indicates whether or not a current timing is immediately after the start of the sewing of the embroidery pattern. When the immediately after flag is set to "0", this indicates that the current timing is not immediately after the sewing of the embroidery pattern has been started. When the immediately after flag is set to "1", this indicates that the current timing is immediately after the sewing of the embroidery pattern has been started.

The sewing machine 2 reads out and acquires the first notification condition and the second notification condition stored in the storage 204 (step S13). The sewing machine 2 reads out the sewing data stored in the storage 204 (step S15). Further, the sewing machine 2 acquires the needle drop data that is first in order in the needle drop data included in the sewing data (step S15). More specifically, of the three sets of needle drop data included in the sewing data, the sewing machine 2 acquires the first needle drop data for the sewing using the thread of the first color. On the basis of a number of the needle drop points specified by the acquired first needle drop data (hereinafter referred to as a "number of stitches") and a time required per sewing stitch, the sewing machine 2 calculates a sewing time required to perform the sewing using the sewing thread in use (step S17). The time required per sewing stitch is calculated using a prescribed rotation speed of the upper shaft motor 206. On the basis of the first needle drop data read out by the processing at step S15, the sewing machine 2 drives the upper shaft motor 206 and the cloth feed motor 207, and starts the sewing of the embroidery pattern using the sewing thread in use of the first color (step S19).

The sewing machine 2 determines whether the needle drop data acquired by the processing at step S15 is the needle drop data to be sewn first in the sewing data (step S21). When it is determined that the needle drop data is the needle drop data to be sewn first (yes at step S21), the sewing machine 2 advances the processing to step S27. The sewing machine 2 continues the sewing of the embroidery pattern started by the processing at step S19 (step S27).

The sewing machine 2 identifies the number of stitches sewn by continuing the sewing, that is, the number of stitches that have already been sewn. The sewing machine 2 subtracts the identified number of stitches that have already been sewn (hereinafter referred to as a "second number of stitches") from the number of stitches specified by the needle drop data acquired by the processing at step S15, that is, from the number of stitches specified by the first needle drop data, which is a total number of stitches required to sew the embroidery pattern using the thread of the first color (hereinafter referred to as a "first number of stitches"). By multiplying a calculation result obtained by subtracting the second number of stitches from the first number of stitches by the time required per sewing stitch, the sewing machine 2 calculates the remaining time period until the completion of the sewing using the sewing thread in use, as the extent of progress (step S29). The sewing machine 2 advances the processing to step S31 (refer to FIG. 3).

Figure 3:
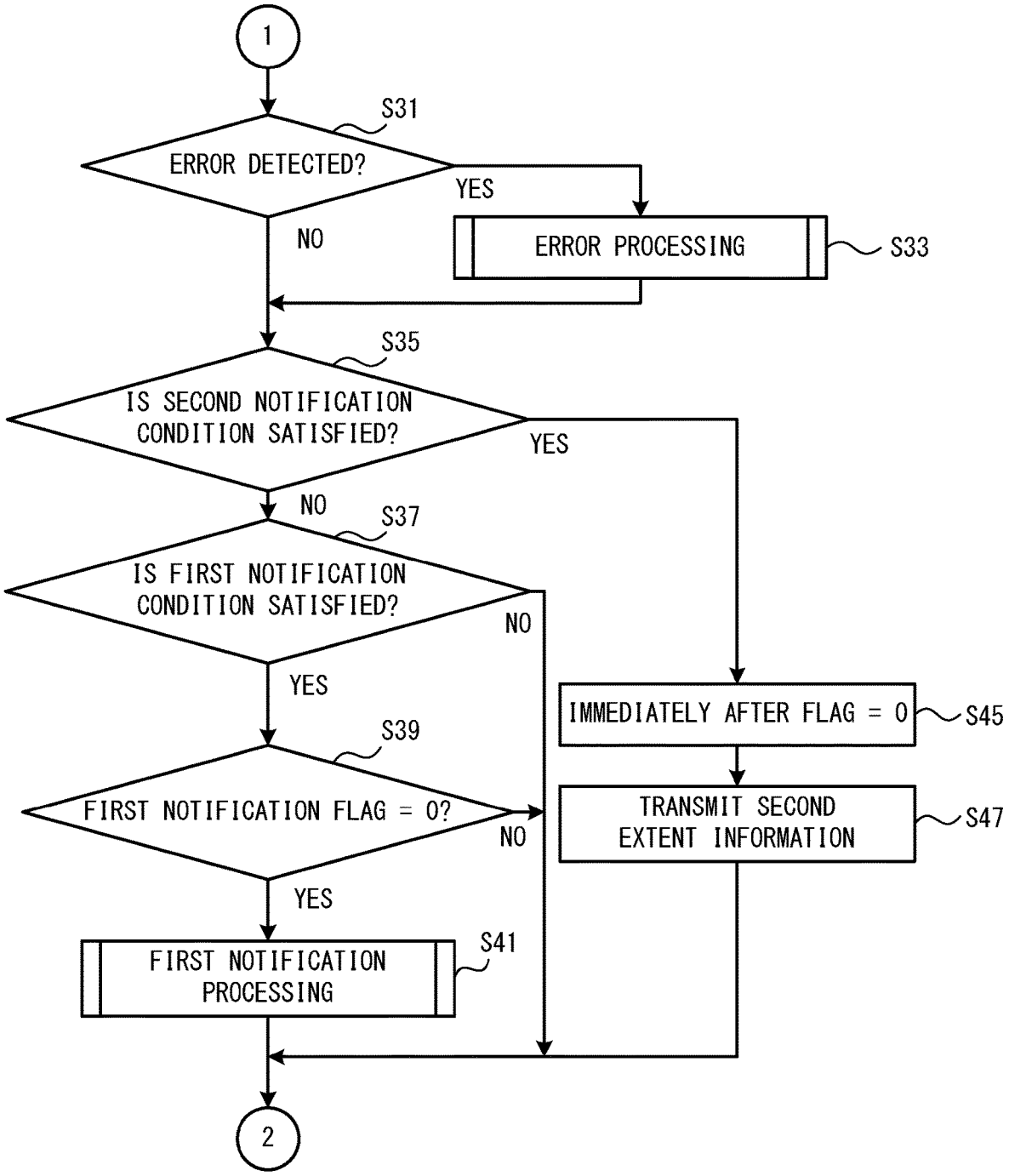
FIG. 3 is a flowchart of the main processing, and is a continuation of FIG. 2.

As shown in FIG. 3, the sewing machine 2 determines whether an error occurring in the course of the sewing of the embroidery pattern has been detected (step S31). Specific examples of the error include skipping a stitch, a thread breakage, and the like. The skipping the stitch and the thread breakage are detected on the basis of a tension of the upper thread detected by a tension sensor (not shown in the drawings) provided in the sewing machine 2. When it is determined that the error has not been detected (no at step S31), the sewing machine 2 advances the processing to step S35.

The sewing machine 2 determines whether the remaining time period calculated as the extent of progress by the processing at step S29 (refer to FIG. 2) satisfies the second notification condition acquired by the processing at step S13 (refer to FIG. 2) (step S35). When the calculated remaining time period, as the extent of progress, is greater than the second remaining time period (zero minutes), the sewing machine 2 determines that the second notification condition is not satisfied (no at step S35). In this case, the sewing of the embroidery pattern using the sewing thread in use on the basis of the first needle drop data acquired at step S15 is not complete. The sewing machine 2 advances the processing to step S37.

The sewing machine 2 determines whether the remaining time period calculated as the extent of progress by the processing at step S29 (refer to FIG. 2) satisfies the first notification condition acquired by the processing at step S13 (refer to FIG. 2) (step S37). When the calculated remaining time period, as the extent of progress, is greater than the first remaining time period (three minutes), the sewing machine 2 determines that the first notification condition is not satisfied (no at step S37). In this case, the remaining time period until the completion of the sewing of the embroidery pattern using the sewing thread in use on the basis of the needle drop points acquired at step S15 is greater than the first remaining time period (three minutes). The sewing machine 2 advances the processing to step S51 (refer to FIG. 4).

Figure 4:
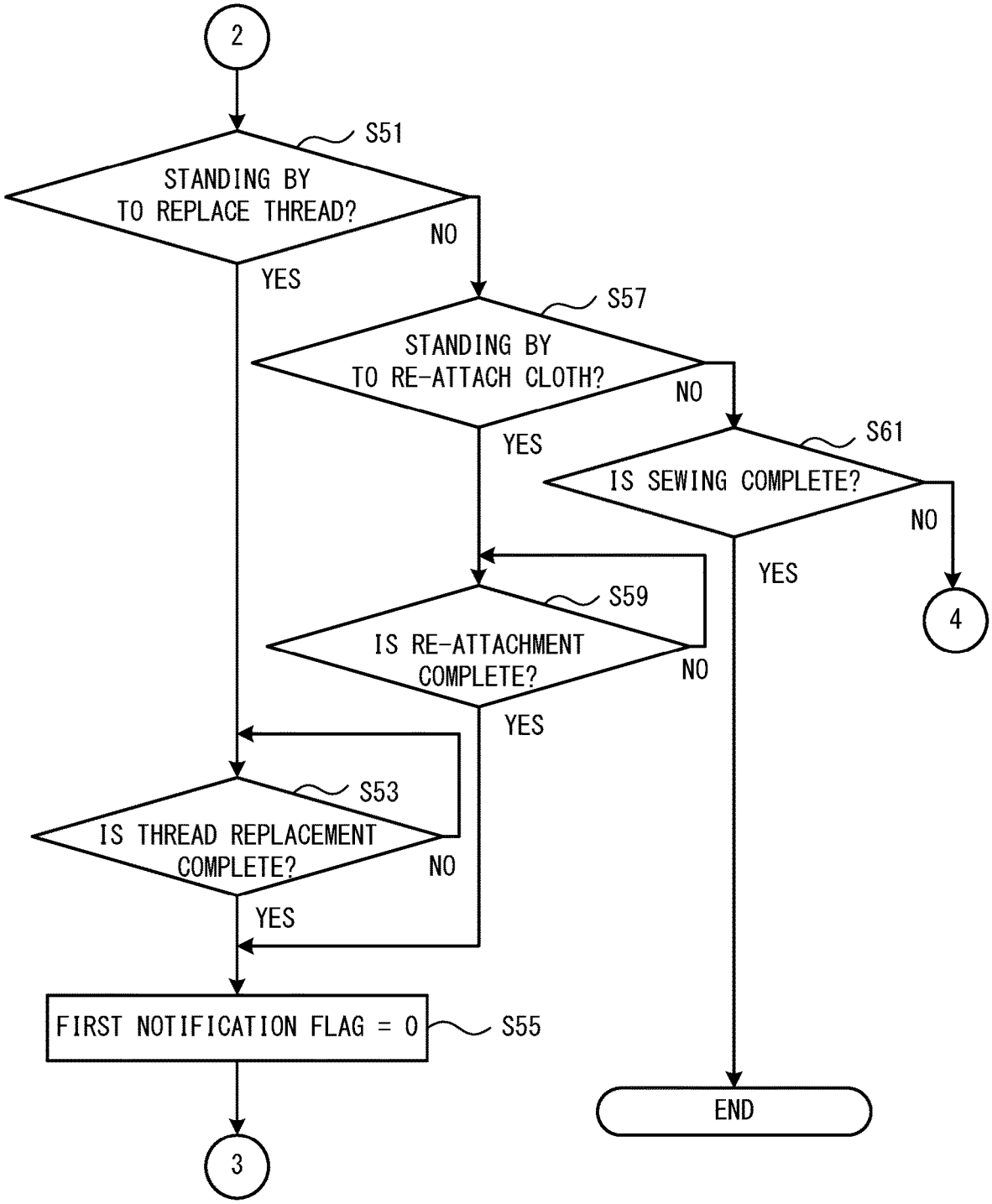
FIG. 4 is a flowchart of the main processing, and is a continuation of FIG. 3.

As shown in FIG. 4, on the basis of whether the following two conditions are satisfied or not, the sewing machine 2 determines whether a state is obtained of standing by for completion of an operation by the user to replace the sewing thread in use (step S51).

(1) The sewing of the embroidery pattern on the basis of the needle drop data acquired at step S15 is complete.

(2) The replacement flag subsequent to the needle drop data acquired at step S15 is included in the sewing data.

Note that condition (1) is determined on the basis of whether or not the remaining time period calculated as the extent of progress by the processing at step S29 (refer to FIG. 2) is zero minutes. When the calculated remaining time period is zero minutes, it is determined that the sewing of the embroidery pattern on the basis of the needle drop data acquired at step S15 is complete. On the other hand, when the calculated remaining time period is greater than zero minutes, it is determined that the sewing of the embroidery pattern on the basis of the needle drop data acquired at step S15 is not complete. When either of the conditions (1) and (2) is not satisfied, the sewing machine 2 determines that the state is not obtained of standing by for the completion of the operation to replace the sewing thread in use (no at step S51).

Next, the sewing machine 2 determines whether a state is obtained of standing by for completion of re-attaching the cloth fixed to the embroidery frame (step S57). The sewing machine 2 determines whether the state is obtained of standing by for the completion of the re-attaching of the cloth fixed to the embroidery frame on the basis of whether the following three conditions are satisfied (step S57).

(a) The condition (1) is satisfied.

(b) The condition (2) is not satisfied.

(c) The re-attachment flag subsequent to the needle drop data acquired at step S15 is included in the sewing data.

When any one of conditions (a) to (c) are not satisfied, the sewing machine 2 determines that the state is not obtained of standing by for the completion of the re-attaching of the cloth fixed to the embroidery frame (no at step S57).

Next, the sewing machine 2 determines whether the sewing of the whole embroidery pattern is complete (step S61). The sewing machine 2 determines whether the sewing of the whole embroidery pattern is complete on the basis of whether the following condition is satisfied (step S61).

(i) The sewing on the basis of all the needle drop data included in the sewing data is complete.

When condition (i) is not satisfied, the sewing machine 2 determines that the sewing of the whole embroidery pattern is not complete (no at step S61). The sewing machine 2 returns the processing to step S27 (refer to FIG. 2), and continues the sewing of the embroidery pattern using the sewing thread in use (step S27).

Figure 2:
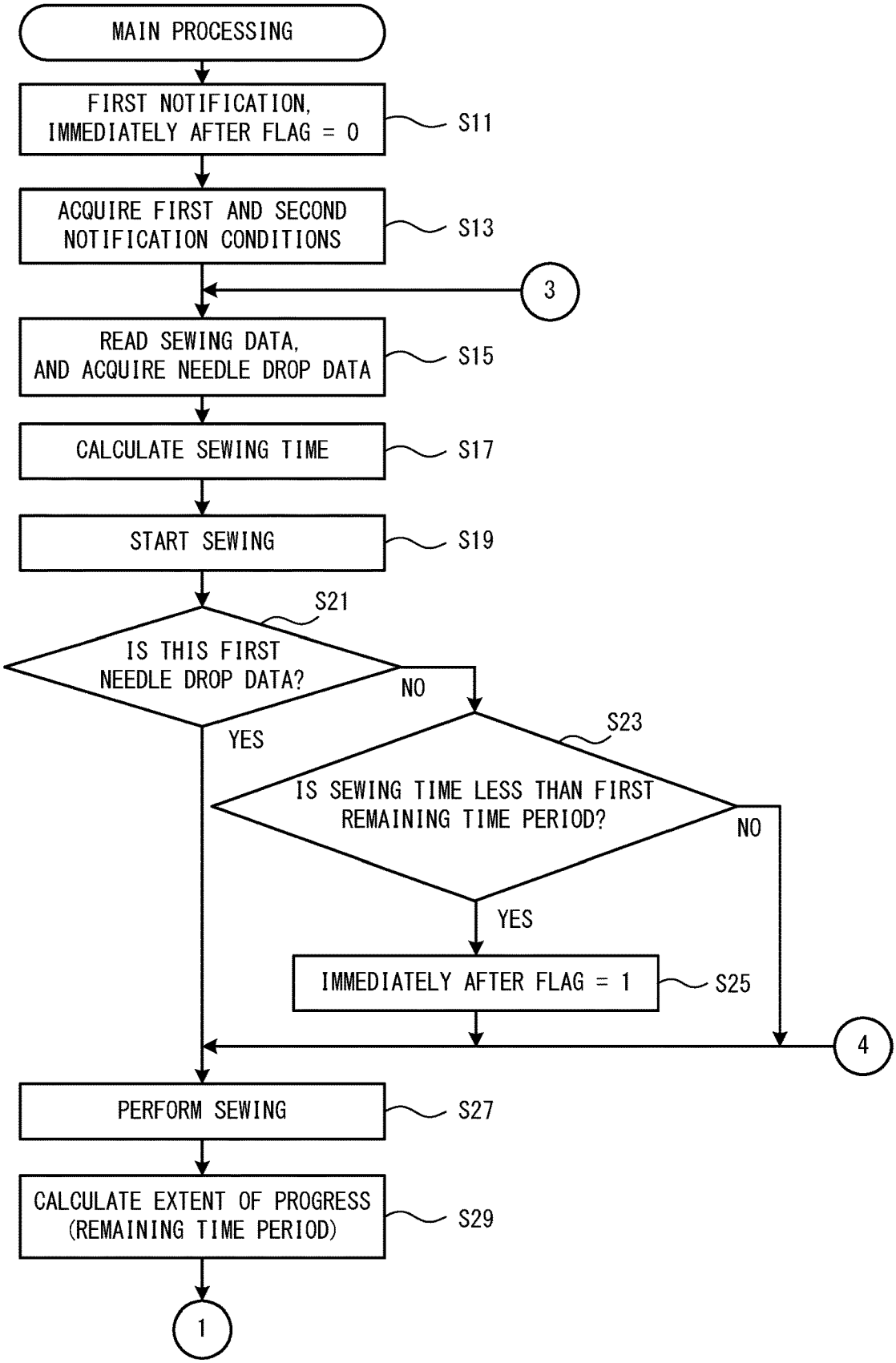
FIG. 2 is a flowchart of main processing.

As shown in FIG. 2, the sewing machine 2 subtracts the second number of stitches, which is the number of stitches that have already been sewn, from the first number of stitches, which is the number of stitches specified in the first needle drop data acquired by the processing at step S15 and is the total number of stitches required to sew the embroidery pattern using the sewing thread in use, and thus calculates the remaining time period until the completion of the sewing using the sewing thread in use, as the extent of progress (step S29). When the sewing of the embroidery pattern is continued, and the remaining time period until the completion of the sewing using the sewing thread in use is greater than the second remaining time period (zero minutes) and equal to or less than the first remaining time period (three minutes), as shown in FIG. 3, the sewing machine 2 determines that the first notification condition is satisfied (no at step S35, yes at step S37). In this case, the remaining time period of a sewing time of the embroidery pattern using the sewing thread in use is equal to or less than the first remaining time period (three minutes). The sewing machine 2 determines whether the first notification flag stored in the RAM 203 is set to "0" (step S39). When it is determined that the first notification flag is set to "0" (yes at step S39), in order to transmit first extent information indicating the first remaining time period (three minutes) to the information processing device 3, the sewing machine 2 performs the first notification processing (refer to FIG. 5) (step S41).

Figure 5:
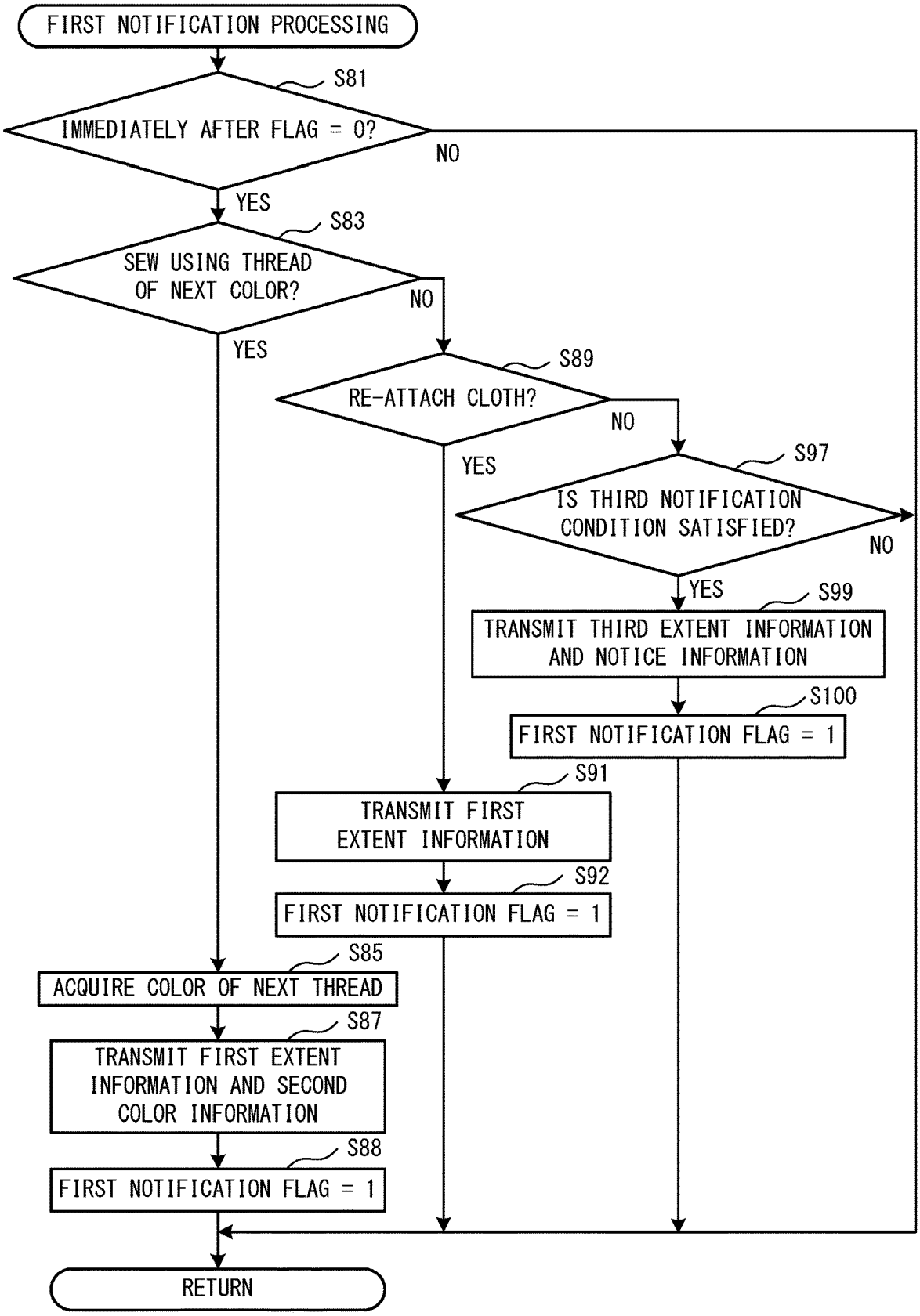
FIG. 5 is a flowchart of first notification processing.

The first notification processing will be described with reference to FIG. 5. The sewing machine 2 determines whether the immediately after flag stored in the RAM 203 is set to "0" (step S81). When it is determined that the immediately after flag is set to "0" (yes at step S81), the sewing machine 2 advances the processing to step S83.

After sewing the embroidery pattern using the sewing thread in use, the sewing machine 2 determines whether to perform the sewing of the embroidery pattern using a next other thread as the sewing thread in use (step S83). More specifically, the sewing machine 2 determines whether the replacement flag subsequent to the first needle drop data acquired at step S15 is included in the sewing data. It is assumed that, after the sewing using the first color that is the color of the sewing thread in use, the sewing of the embroidery pattern is performed using the thread of the second color as the next thread. On the basis of the replacement flag for replacing the thread with the thread of another color included in the sewing data subsequent to the first needle drop data for the sewing using the thread of the first color acquired by the processing at step S15 (refer to FIG. 2), the sewing machine 2 determines to perform the sewing of the embroidery pattern using the next thread that is different from the sewing thread in use (yes at step S83). In this case, on the basis of the color data, the sewing machine 2 acquires the second color that is the color of the thread to be sewn subsequent to the sewing thread in use (step S85). The sewing machine 2 transmits, to the information processing device 3, the first extent information indicating the first remaining time period (three minutes), and information of the second color acquired by the processing at step S85 '(hereinafter referred to as "second color information") (step S87). A method of transmitting the information to the information processing device 3 will be described in detail later (refer to FIG. 8 and FIG. 10). The sewing machine 2 sets the first notification flag stored in the RAM 203 to "1" (step S88). The sewing machine 2 ends the first notification processing and returns the processing to the main processing (refer to FIG. 3).

Note that, in addition to the first extent information and the second color information transmitted at step S87, the sewing machine 2 may also further transmit, to the information processing device 3, first color information indicating the first color that is the color of the sewing thread in use. In addition, the sewing machine 2 may further transmit, to the information processing device 3, replacement notification information for performing notification that it is necessary to replace the sewing thread in use.

As shown in FIG. 3, the sewing machine 2 advances the processing to step S51 (refer to FIG. 4) after the first notification processing (step S41). As shown in FIG. 4, when it is not the state of standing by for the completion of the operation to replace the sewing thread in use, and of standing by for the completion of the re-attachment of the cloth fixed to the embroidery frame (no at step S51, no at step S57), and the sewing of the whole embroidery pattern is not complete (no at step S61), the sewing machine 2 returns the processing to step S27 (refer to FIG. 2). The sewing machine 2 continues the sewing of the embroidery pattern using the sewing thread in use (step S27).

As shown in FIG. 2, the sewing machine 2 subtracts the second number of stitches, which is the number of stitches that have already been sewn, from the first number of stitches, which is the number of stitches specified in the first needle drop data acquired by the processing at step S15 and is the total number of stitches required to sew the embroidery pattern using the sewing thread in use, and thus calculates the remaining time period until the completion of the sewing using the sewing thread in use, as the extent of progress (step S29). When the sewing of the embroidery pattern is continued, the remaining time period calculated at step S29 is continuously greater than zero minutes and equal to or less than two minutes. As shown in FIG. 3, the sewing machine 2 continues to determine that the first notification condition is satisfied (no at step S35, yes at step S37). However, in the first notification processing (refer to FIG. 5), the first notification flag is set to "1" (step S88). By the processing at step S39, the sewing machine 2 determines that the first notification flag is not set to "0" (no at step S39), and advances the processing to step S51 (refer to FIG. 4). Thus, the first notification processing (step S41) is not repeatedly performed, and the first extent information and the like is not transmitted to the information processing device 3.

It is assumed that an error occurs during the continuous sewing of the embroidery pattern using the sewing thread in use. In this case, as shown in FIG. 3, the sewing machine 2 detects the error (yes at step S31), and performs error processing (refer to FIG. 6) (step S33).

Figure 6:
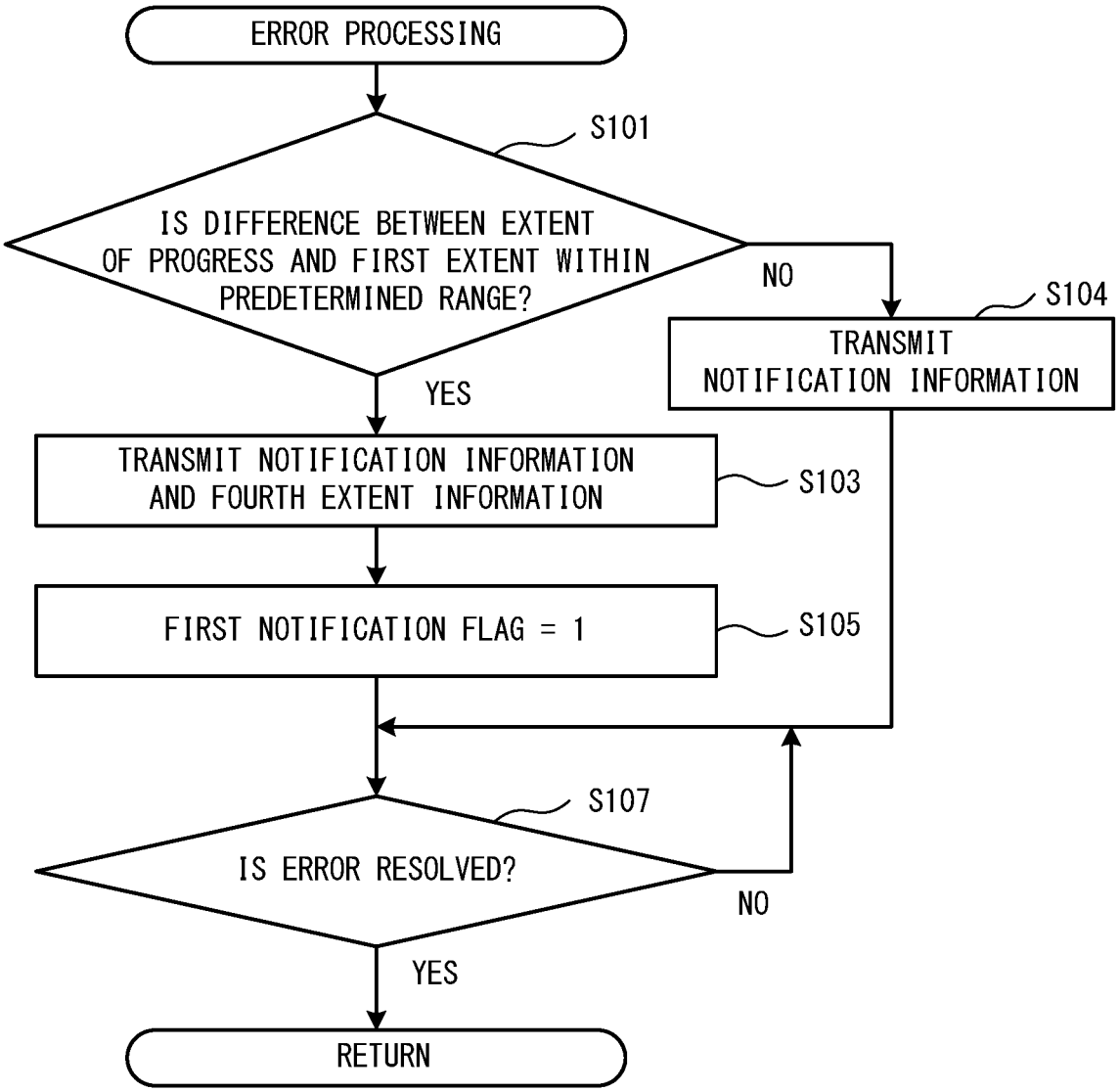
FIG. 6 is a flowchart of error processing.

The error processing will be described with reference to FIG. 6. The sewing machine 2 calculates a difference between the remaining time period calculated as the extent of progress by the processing at step S29 (refer to FIG. 2) immediately preceding the detection of the error and the first remaining time period (three minutes). The sewing machine 2 determines whether the calculated difference is within a predetermined range (one minute, for example) (step S101).

When it is determined that the difference is within the predetermined range (yes at step S101), the sewing machine 2 advances the processing to step S103. The sewing machine 2 transmits, to the information processing device 3, information for notifying the occurrence of the error (hereinafter referred to as "error notification information"), and information indicating the remaining time period calculated as the extent of progress by the processing at step S29 (hereinafter referred to as "fourth extent information") (step S103). A method of transmitting the information to the information processing device 3 will be described in detail later (refer to FIG. 8 and FIG. 10). The sewing machine 2 sets the first notification flag stored in the RAM 203 to "1" (step S105). In this way, even when the first notification condition is satisfied by continuing the sewing after resolving the error, the transmission of the first extent information and the like by the first notification processing (refer to FIG. 5) is prohibited (no at step S39, refer to FIG. 3). The sewing machine 2 advances the processing to step S107.

On the other hand, when it is determined that the difference between the remaining time period calculated as the extent of progress by the processing at step S29 (refer to FIG. 2) and the first remaining time period (three minutes) is outside the predetermined range (no at step S101), the sewing machine 2 transmits the error notification information to the information processing device 3 (step S104). The sewing machine 2 advances the processing to step S107.

The sewing machine 2 determines whether the detected error has been resolved (step S107). During a period in which the detected error is not resolved (no at step S107), the sewing machine 2 returns the processing to step S107, and stands by until the error is resolved. Here, for example, the user operates the sewing machine 2 to resolve the error. When it is determined that the detected error has been resolved (yes at step S107), the sewing machine 2 ends the error processing and returns the processing to the main processing. As shown in FIG. 3, after ending the error processing (step S33), the sewing machine 2 advances the processing to step S35.

The sewing of the embroidery pattern using the sewing thread in use is continued (step S27). It is assumed that, as a result, the remaining time period calculated by the processing at step S29 matches the second remaining time period (zero minutes). As shown in FIG. 3, the sewing machine 2 determines that the second notification condition is satisfied (yes at step S35). In this case, the sewing of the embroidery pattern using the sewing thread in use on the basis of the first needle drop data acquired at step S15 is complete. In order to transmit second extent information indicating the second remaining time period (zero minutes) to the information processing device 3, the sewing machine 2 advances the processing to step S45.

The sewing machine 2 sets the immediately after flag stored in the RAM 203 to "0" (step S45). The sewing machine 2 transmits the second extent information to the information processing device 3 (step S47). A method of transmitting the information to the information processing device 3 will be described in detail later (refer to FIG. 8 and FIG. 10). Note that, in addition to the second extent information, the sewing machine 2 may also transmit, to the information processing device 3, the first color information indicating the first color that is the color of the sewing thread in use at step S47. Further, in addition to the second extent information, the sewing machine 2 may also transmit the second color information to the information processing device 3 at step S47. The sewing machine 2 advances the processing to step S51 (refer to FIG. 4).

As shown in FIG. 4, the sewing machine 2 determines whether the state is obtained of standing by for the completion of the operation by the user to replace the sewing thread in use (step S51). When conditions (1) and (2) are satisfied, that is, when (1) the sewing of the embroidery pattern on the basis of the needle drop data acquired at step S15 is complete, and (2) the replacement flag subsequent to the needle drop data acquired at step S15 is included in the sewing data, the sewing machine 2 determines that it is the state of standing by for the completion of the operation to replace the sewing thread in use (yes at step S51).

On the basis of the color data included in the sewing data stored in the storage 204, the sewing machine 2 identifies the second color that is the color of the thread to be used after the sewing by the sewing thread in use that is the first color. The sewing machine 2 displays the identified second color on the LCD 208 and prompts the user to replace the upper thread. The sewing machine 2 stands by until the replacement of the upper thread is complete (no at step S53). After replacing the upper thread, the user performs an input operation, via the operation portion 209, indicating that the replacement is complete. When the input operation is received, the sewing machine 2 determines that the replacement of the thread to the new sewing thread in use is complete (yes at step S53). The sewing machine 2 sets the first notification flag stored in the RAM 203 to "0" (step S55). The sewing machine 2 returns the processing to step S15 (refer to FIG. 2).

As shown in FIG. 2, the sewing machine 2 reads out the sewing data stored in the storage 204 (step S15), and acquires the second needle drop data included after the first needle drop data for sewing the thread of the first color (step S15). In other words, the sewing machine 2 acquires the needle drop data for sewing the first portion of the embroidery pattern using the second color that is the color of the sewing thread in use after the replacement. The sewing machine 2 calculates the sewing time required to sew the embroidery pattern using the sewing thread in use, on the basis of the number of stitches specified in the acquired second needle drop data and the time required per sewing stitch (step S17). On the basis of the second needle drop data newly read out by the processing at step S15, the sewing machine 2 drives the upper shaft motor 206 and the cloth feed motor 207, and starts the sewing of the embroidery pattern using the sewing thread in use of the second color (step S19).

The sewing machine 2 determines that the second needle drop data acquire by the processing at step S15 is not the needle drop data to be sewn first in the sewing data (no at step S21). The sewing machine 2 determines whether the sewing time calculated by the processing at step S17 is less than the first remaining time period (three minutes) (step S23). In other words, the sewing machine 2 determines whether the remaining time period of the sewing based on the second needle drop data newly acquired at step S15 already satisfies the first notification condition. When it is determined that the sewing time is less than the first remaining time period (three minutes) (yes at step S23), the sewing machine 2 sets the immediately after flag stored in the RAM 203 to "1" (step S25). The sewing machine 2 advances the processing to step S27.

The sewing of the first portion of the embroidery pattern using the sewing thread in use of the second color is continued (step S27). The remaining time period calculated by the processing at step S29 (refer to FIG. 2) becomes greater than the second remaining time period (zero minutes) and less than the first remaining time period (three minutes). In this case, as shown in FIG. 3, the sewing machine 2 determines that the first notification condition is satisfied (no at step S35, yes at step S37). In the first notification processing (step S41) shown in FIG. 5, the sewing machine 2 determines that the immediately after flag stored in the RAM 203 is set to "1" (no at step S81), and ends the first notification processing without transmitting the first extent information to the information processing device 3.

On the other hand, as shown in FIG. 2, when it is determined that the sewing time calculated by the processing at step S17 (refer to FIG. 2) is equal to or greater than the first remaining time period (three minutes) (no at step S23), the sewing machine 2 advances the processing to step S27 without setting the immediately after flag stored in the RAM 203 to "1". It is assumed that, subsequently, the sewing of the embroidery pattern is continued, and the remaining time period calculated by the processing at step S29 (refer to FIG. 2) becomes greater than the second remaining time period (zero minutes) and equal to or less than the first remaining time period (three minutes). In this case, as shown in FIG. 3, the sewing machine 2 determines that the first notification condition is satisfied (no at step S35, yes at step S37). As shown in FIG. 5, in the first notification processing (step S41), the sewing machine 2 determines that the immediately after flag stored in the ram is set to "0" (yes at step S81). The sewing machine 2 advances the processing to step S83.

Here, after the sewing using the sewing thread in use ends, when performing the sewing using the thread of another color (yes at step S83), the first extent information and the like are transmitted to the information processing device 3 (step S87). However, the color of the sewing thread in use is the second color, and the sewing of the embroidery pattern using the thread of another color is not performed. On the basis of the color data included in the sewing data, the sewing machine 2 determines that the sewing of the embroidery pattern using the next thread of the color different from the sewing thread in use of the second color is not to be performed (no at step S83). Note that this determination may be performed on the basis of whether the replacement flag is included in the sewing data after the second needle drop data acquired at step S15.

Next, after the sewing using the sewing thread in use, the sewing machine 2 determines whether to perform the re-attachment of the cloth fixed to the embroidery frame, on the basis of the re-attachment flag (step S89). More specifically, the sewing machine 2 determines whether the re-attachment flag subsequent to the second needle drop data acquired at step S15 is included in the sewing data. When the re-attachment flag is included in the sewing data, the sewing machine 2 determines to perform the re-attachment of the cloth after the sewing based on the second needle drop data acquired at step S15 (yes at step S89). In this case, the sewing machine 2 transmits, to the information processing device 3, the first extent information indicating the first remaining time period (three minutes) (step S91). In addition to the first extent information, the sewing machine 2 may transmit, to the information processing device 3, re-attachment information indicating that the re-attachment of the cloth to the embroidery frame is necessary. A method of transmitting the information to the information processing device 3 will be described in detail later (refer to FIG. 8 and FIG. 10). The sewing machine 2 sets the first notification flag stored in the RAM 203 to "1" (step S92). The sewing machine 2 ends the first notification processing and returns the processing to the main processing (refer to FIG. 3).

The sewing machine 2 further continues the sewing of the embroidery pattern using the sewing thread in use. As a result, it is assumed that the remaining time period calculated by the processing at step S29 shown in FIG. 2 matches the second remaining time period (zero minutes). As shown in FIG. 3, the sewing machine 2 determines that the second notification condition is satisfied (yes at step S35). In this case, since the sewing of the first portion of the embroidery pattern using the sewing thread in use of the second color is complete, the sewing machine 2 transmits the second extent information to the information processing device 3 (step S47). Note that, in addition to the second extent information, the sewing machine 2 may transmit, to the information processing device 3, the re-attachment information indicating that the re-attachment of the cloth to the embroidery frame is necessary.

As shown in FIG. 4, since the replacement flag subsequent to the second needle drop data acquired at step S15 is not included, the sewing machine 2 determines that condition (2) is not satisfied (no at step S51). On the other hand, since the re-attachment flag subsequent to the second needle drop data acquired at step S15 is included in the sewing data, this means that conditions (a) to (c) are satisfied, and thus, the sewing machine 2 determines that the state is obtained of standing by to complete the re-attachment of the cloth attached to the embroidery frame (yes at step S57). The sewing machine 2 stands by until the re-attachment of the cloth to the embroidery frame is complete (no at step S59). The sewing machine 2 displays, on the LCD 208, a message indicating that the re-attachment of the cloth to the embroidery frame is necessary, and prompts the user to re-attach the cloth. After re-attaching the cloth to the embroidery frame, the user performs an input operation, via the operation portion 209, indicating that the re-attachment is complete. When the input operation is received, the sewing machine 2 determines that the re-attachment of the cloth to the embroidery frame is complete (yes at step S59). The sewing machine 2 sets the first notification flag stored in the RAM 203 to "0" (step S55). The sewing machine 2 returns the processing to step S15 (refer to FIG. 2).

As shown in FIG. 2, the sewing machine 2 reads out the sewing data stored in the storage 204 (step S15), and acquires the third needle drop data included subsequent to the second needle drop data for sewing the first portion of the embroidery pattern using the thread of the second color (step S15). In other words, the sewing machine 2 newly acquires the needle drop data for sewing the second portion of the embroidery pattern using the thread of the second color. On the basis of the number of stitches specified by the acquired needle drop data, and the time required per sewing stitch, the sewing machine 2 calculates the sewing time required for the sewing of the embroidery pattern using the sewing thread in use (step S17). On the basis of the third needle drop data newly read out by the processing at step S15, the sewing machine 2 drives the upper shaft motor 206 and the cloth feed motor 207, and starts the sewing of the embroidery pattern using the sewing thread in use of the second color (step S19).

It is assumed that the sewing machine 2 continues the sewing of the second portion of the embroidery pattern using the sewing thread in use, and the remaining time period calculated by the processing at step S29 (refer to FIG. 2) becomes greater than the second remaining time period (zero minutes) and equal to or less than the first remaining time period (three minutes). In this case, as shown in FIG. 3, the sewing machine 2 determines that the first notification condition is satisfied (no at step S35, yes at step S37). As shown in FIG. 5, in the first notification processing (step S41), the sewing machine 2 determines that "0" is set for the immediately after flag stored in the RAM 203 (yes at step S81). The sewing machine 2 advances the processing to step S83.

Here, after ending the sewing using the sewing thread in use, when the sewing is performed using the thread of another color (yes at step S83), the first extent information and the like are transmitted to the information processing device 3 (step S87). Further, after ending the sewing using the sewing thread in use, when the re-attachment of the cloth is to be performed (yes at step S89), the first extent information and the like are transmitted to the information processing device 3 (step S91). However, on the basis of the color data included in the sewing data, the sewing machine 2 determines that the sewing of the embroidery pattern using the next thread of the color different from the sewing thread in use of the second color is not to be performed (no at step S83). Furthermore, when the re-attachment flag subsequent to the third needle drop data newly acquired at step S15 is not included in the sewing data, the sewing machine 2 determines that the re-attachment is not to be performed after the sewing using the sewing thread in use (no at step S89). In this case, since the sewing using the thread of the other color is not to be performed after the sewing using the sewing thread in use of the second color (no at step S83), and the re-attachment of the cloth is not to be performed (no at step S89), this means that the sewing of the whole embroidery pattern is complete, by the completion of the sewing using the sewing thread in use.

The sewing machine 2 determines whether the remaining time period calculated as the extent of progress by the processing at step S29 (refer to FIG. 2) satisfies a third notification condition (step S97). The third notification condition is a condition for notifying that the remaining time period until the completion of the sewing (hereinafter referred to as a "third remaining time period") is one minute. The third remaining time period (one minute) is less than the first remaining time period (three minutes) and is greater than the second remaining time period (zero minutes). When the calculated remaining time period is greater than the third remaining time period (one minute), the sewing machine 2 determines that the third notification condition is not satisfied (no at step S97). In this case, the sewing machine 2 ends the first notification processing, and returns the processing to the main processing (refer to FIG. 3).

When the sewing of the second portion of the embroidery pattern is continued using the sewing thread in use, and the remaining time period calculated by the processing at step S29 (refer to FIG. 2) is equal to or less than the third remaining time period (one minute), the sewing machine 2 determines that the third notification condition is satisfied (yes at step S97). In this case, the remaining time period until the sewing of the second portion of the embroidery pattern using the sewing thread in use is complete is equal to or less than the third remaining time period (one minute), and this means that the sewing of the whole embroidery pattern is complete, by the completion of the sewing by the sewing thread in use. The sewing machine 2 transmits, to the information processing device 3, third extent information indicating the third remaining time period (one minute), and notice information giving advance notice of the completion of the sewing of the second portion of the embroidery pattern (step S99). Note that the notice information may be included in information giving advance notice of the completion of the sewing of the whole embroidery pattern. A method of transmitting the information to the information processing device 3 will be described in detail later (refer to FIG. 8 and FIG. 10). The sewing machine 2 sets the first notification flag stored in the RAM 203 to "1" (step S100). The sewing machine 2 returns the processing to the main processing (refer to FIG. 3).

The sewing machine 2 further continues the sewing of the second portion of the embroidery pattern using the sewing thread in use of the second color. It is assumed that, as a result, the remaining time period calculated by the processing at step S29 matches the second remaining time period (zero minutes). As shown in FIG. 3, the sewing machine 2 determines that the second notification condition is satisfied (yes at step S35). In this case, the sewing of the second portion of the embroidery pattern using the sewing thread in use of the second color is complete, and thus, the sewing machine 2 transmits the second extent information to the information processing device 3 (step S47). In addition to the second extent information, the sewing machine 2 may transmit, to the information processing device 3, information indicating that the sewing of the whole embroidery pattern is complete.

As shown in FIG. 4, after the sewing of the embroidery pattern using the sewing thread in use of the second color, the sewing using the thread of the other color is not to be performed (no at step S51), and thus, the sewing machine 2 advances the processing to step S57. Furthermore, since the re-attachment flag subsequent to the third needle drop data for sewing the second portion of the embroidery pattern using the thread of the second color acquired at step S15 is not included, and condition (c) is not satisfied, the sewing machine 2 determines that the state is not obtained of standing by for the completion of the re-attachment of the cloth to the embroidery frame (no at step S57). In this case, the sewing of the second portion of the embroidery pattern using the sewing thread in use of the second color is complete, and the sewing based on all of the needle drop data included in the sewing data is complete as a result of the sewing of the second portion of the embroidery pattern using the sewing thread in use, and thus, condition (i) is satisfied. The sewing machine 2 determines that the sewing of the whole embroidery pattern is complete (yes at step S61), and ends the main processing.

Hereinafter, when no distinction is made between the first extent information (step S87 and step S91, refer to FIG. 5), the second extent information (step S47, refer to FIG. 3), the third extent information (step S99, refer to FIG. 5), the fourth extent information (step S103, refer to FIG. 6), the second color information (step S87, refer to FIG. 5), and the notice information (step S99, refer to FIG. 5) that are transmitted from the sewing machine 2 by performing the main processing, these pieces of information will be collectively referred to as "notification information."

Setting Processing

Figure 7:
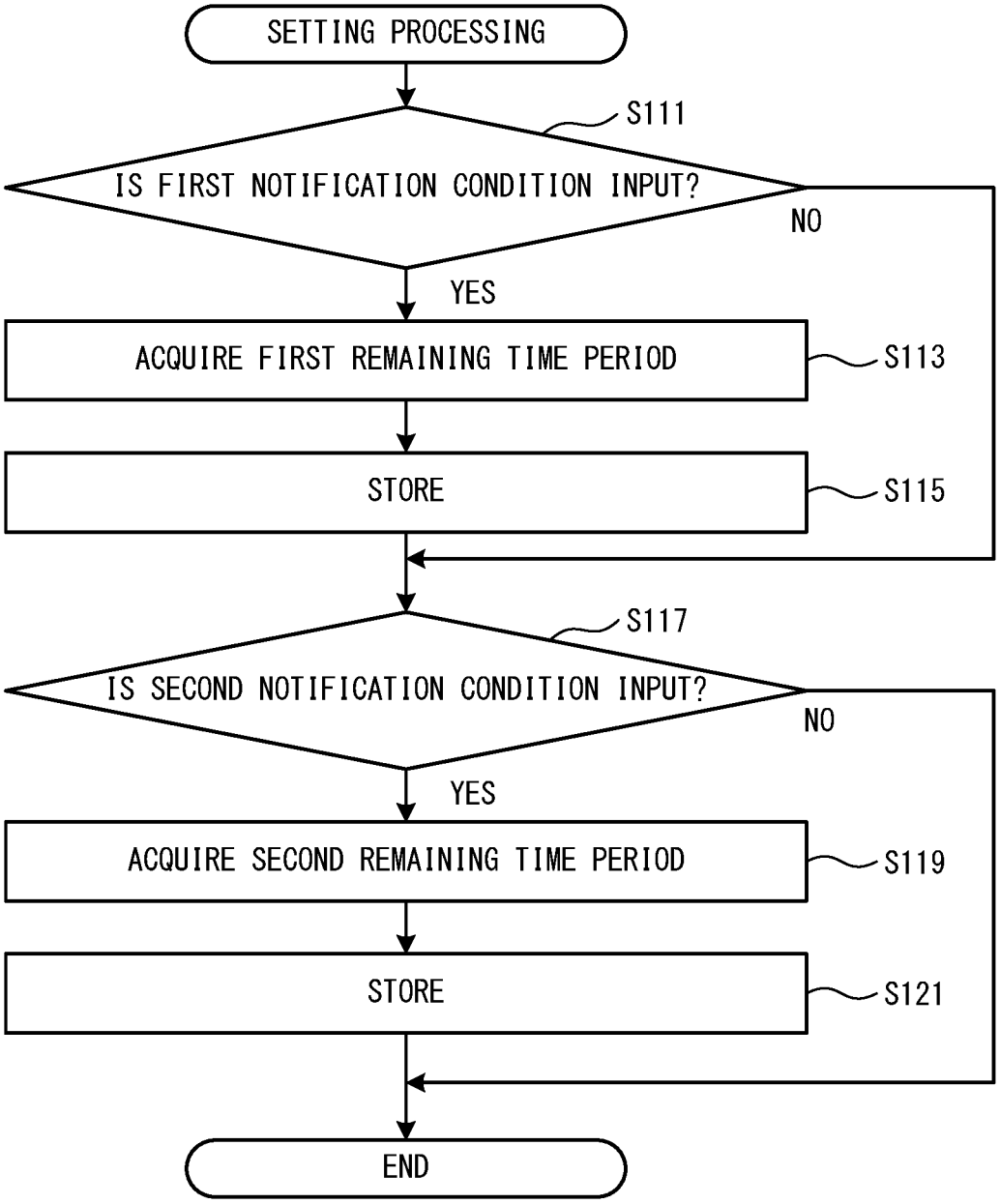
FIG. 7 is a flowchart of setting processing.

Setting processing will be described with reference to FIG. 7. When the sewing machine 2 detects, via the operation portion 209, an input operation for starting the setting of the first notification condition and the second notification condition, the sewing machine 2 starts the setting processing by reading out a program stored in the storage 204 and executing the read program.

The sewing machine 2 determines whether an input operation to input the first remaining time period as the first notification condition has been detected via the operation portion 209 (step S111). When the input operation to input the first remaining time period has been detected (yes at step S111), the sewing machine 2 acquires the first remaining time period input by the input operation (step S113). The sewing machine 2 stores the acquired first remaining time period in the storage 204 (step S115). The sewing machine 2 advances the processing to step S117. On the other hand, when the input operation to input the first remaining time period has not been detected (no at step S111), the sewing machine 2 advances the processing to step S117.

The sewing machine 2 determines whether an input operation to input the second remaining time period as the second notification condition has been detected via the operation portion 209 (step S117). When the input operation to input the second remaining time period has been detected (yes at step S117), the sewing machine 2 acquires the second remaining time period input by the input operation (step S119). The sewing machine 2 stores the acquired second remaining time period in the storage 204 (step S121). The sewing machine 2 ends the setting processing. On the other hand, when the input operation to input the second remaining time period has not been detected (no at step S117), the sewing machine 2 ends the setting processing.

Communication Processing

Figure 8:
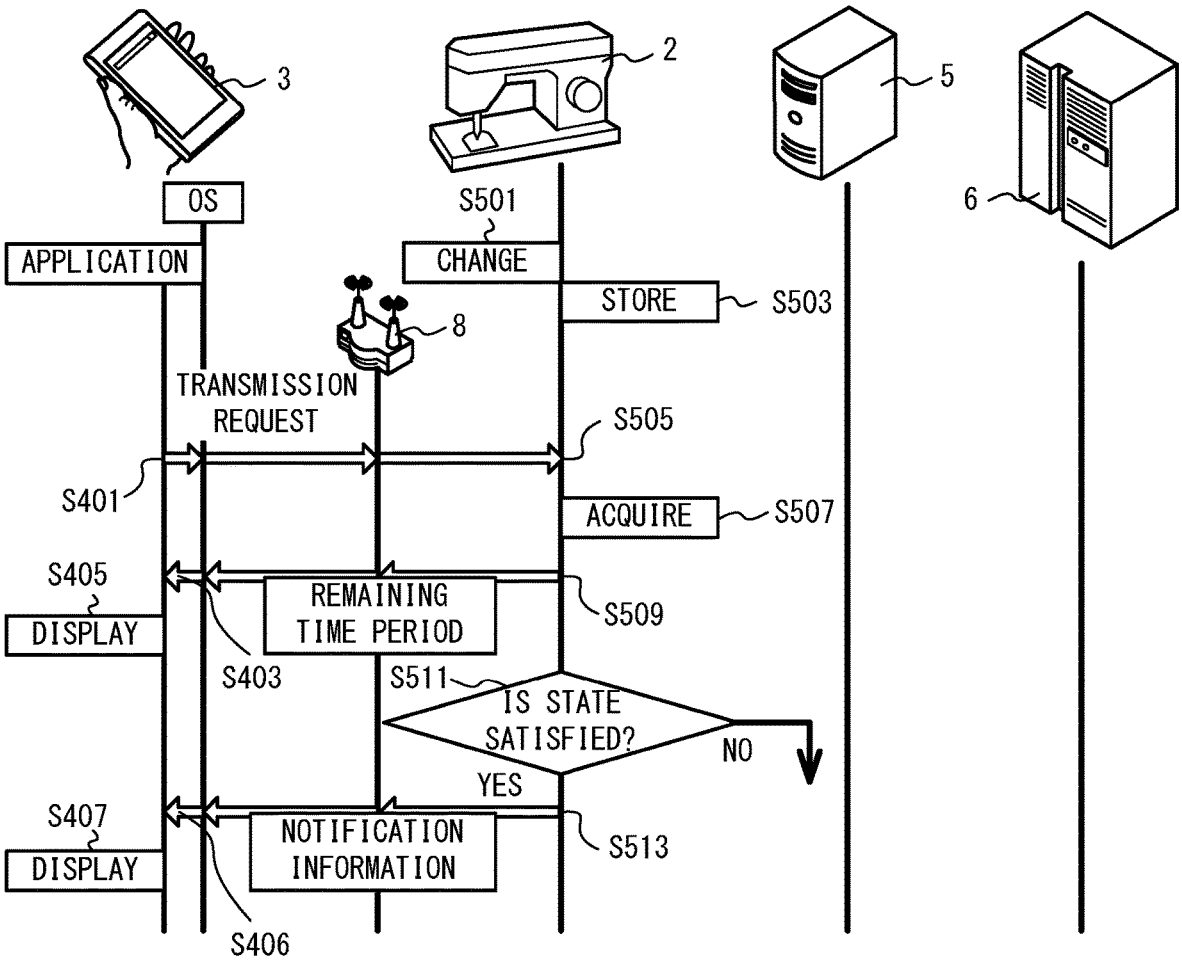
FIG. 8 is a diagram showing a communication sequence of first communication processing (application: foreground).

First communication processing and second communication processing will be described, as communication sequences in the notification system 1, with reference to FIG. 8. In the first communication processing, the communication is performed via the path R1 (refer to FIG. 1). In the first communication processing, in addition to the notification information being transmitted from the sewing machine 2 to the information processing device 3 in the main processing (refer to FIG. 2 to FIG. 5), communication is included in which extent of progress information is transmitted from the sewing machine 2 in response to a periodic request from the information processing device 3. Note that, in the following description, a state is assumed in which a communication session is established between the sewing machine 2 and the information processing device 3. Further, it is assumed that the application is already activated in the information processing device 3, that the OS is not in the sleep state, and the application is running in the foreground.

The sewing machine 2 constantly detects, as the extent of progress, each of the remaining time period until the completion of the sewing of the embroidery pattern using the thread of the first color, the remaining time period until the completion of the sewing of the first portion of the embroidery pattern using the thread of the second color, and the remaining time period until the completion of the sewing of the second portion of the embroidery pattern using the thread of the second color. When the detected remaining time period changes (step S501), the sewing machine 2 stores the extent of progress information indicating the remaining time period after the change in the storage 204 (step S503). When the application is running in the foreground, the information processing device 3 transmits, to the sewing machine 2 via the LAN 7A, a command requesting the extent of progress information (referred to as a "transmission request"), using a transmission function of the application (hereinafter referred to as a "App transmission function") (step S401). At this time, the transmission request is relayed via the access point 8. The sewing machine 2 receives, via the LAN 7A, the transmission request transmitted from the information processing device 3 (step S505).

When the extent of progress information is stored in the storage 204 by the processing at step S503, the sewing machine 2 acquires the extent of progress information (step S507). The sewing machine 2 transmits the acquired extent of progress information, via the LAN 7A, to the information processing device 3 that has transmitted the transmission request (step S509). At this time, the extent of progress information is relayed via the access point 8. The information processing device 3 receives the extent of progress information transmitted from the sewing machine 2 via the LAN 7A, using a reception function of the application (hereinafter referred to as an "App reception function") (step S403). Using a display function of the application (hereinafter referred to as an "App display function"), the information processing device 3 displays the remaining time period indicated by the received extent of progress information on the LCD 308 (step S405). In this way, the remaining time period until the completion of the sewing of the embroidery pattern in the sewing machine 2 is notified to the user of the information processing device 3. As described above, since the information processing device 3 periodically transmits the transmission request, the information processing device 3 periodically displays the remaining time period on the LCD 308.

In the above description, the sewing machine 2 may include the color information indicating the color of the sewing thread in use during the sewing, in the extent of progress information transmitted to the information processing device 3 in response to the transmission request. Further, the sewing machine 2 may include ratio information indicating a ratio of a portion, of the whole embroidery pattern, for which the sewing is already complete, in the extent of progress information transmitted to the information processing device 3 in response to the transmission request.

When it is determined to transmit the notification information to the information processing device 3 by performing the main processing (refer to FIG. 2 to FIG. 5) (yes at step S511), the sewing machine 2 transmits the notification information to the information processing device 3, via the LAN 7A, regardless of whether or not the transmission request has been received (step S513). At this time, the notification information is relayed via the access point 8. Note that, instead of transmitting the notification information to the information processing device 3 via the LAN 7A, the sewing machine 2 may transmit the notification information to the information processing device 3 via the public network 7B. Using the App reception function, the information processing device 3 receives the notification information transmitted from the sewing machine 2, via the LAN 7A (step S406). The information processing device 3 displays the received notification information on the LCD 308, using the App display function (step S407).

For example, when it is determined that the first notification condition is satisfied (yes at step S37, refer to FIG. 3), the sewing machine 2 transmits the first extent information (step S87, step S91, refer to FIG. 5), the third extent information (step S99, refer to FIG. 5), the second color information (step S87, refer to FIG. 5), the notice information (step S99, refer to FIG. 5), and the like to the information processing device 3 (step S513). Further, for example, when it is determined that the second notification condition is satisfied (yes at step S35, refer to FIG. 3), the sewing machine 2 transmits the second extent information (step S47, refer to FIG. 3) to the information processing device 3 (step S513). In addition, for example, when the error is detected, the sewing machine 2 transmits the notification information and the fourth extent information to the information processing device 3 (step S103, refer to FIG. 6).

Figure 9:
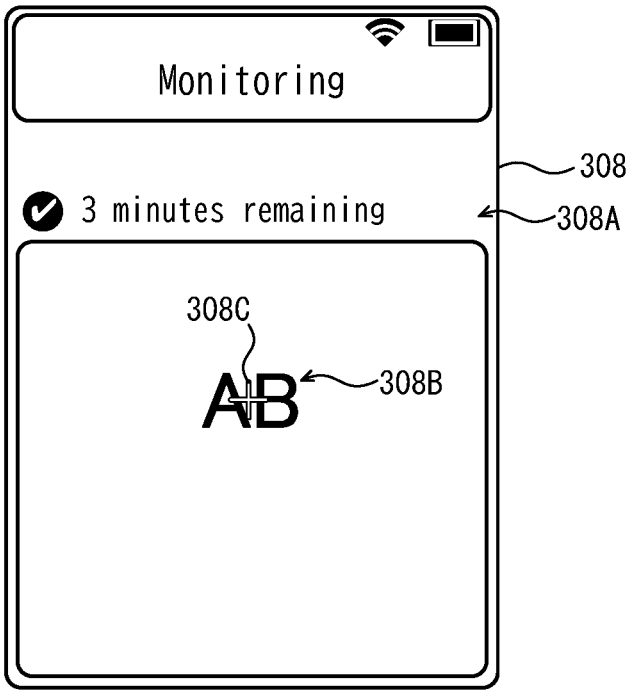
FIG. 9 is a diagram showing a screen displayed on an LCD by the first communication processing.

FIG. 9 shows a screen displayed on the LCD 308 in response that the information processing device 3 has received the first extent information. Note that, the first remaining time period (three minutes) is indicated in the first extent information, and thus, on the screen displayed on the LCD 308, a message 308A is displayed that indicates that the remaining time period until the completion of the sewing of the embroidery pattern is the first remaining time period (three minutes). Note that the sewing data of the embroidery pattern to be sewn in the sewing machine 2 may be stored in the storage 304 of the information processing device 3. In this case, as shown in FIG. 9, an image 308B of the embroidery pattern that has been sewn may be displayed on the screen displayed on the LCD 308. Furthermore, a mark 308C indicating the position of the needle drop point after the sewing of the embroidery pattern may be displayed on the screen displayed on the LCD 308.

The second communication processing is performed in parallel with the first communication processing. In the second communication processing, the communication is performed via the path R2 (refer to FIG. 1). Further, in the second communication processing, on the basis of a request for a push notification transmitted from the sewing machine 2, the push notification is performed in the information processing device 3. In the second communication processing, the communication is included in which the notification information is transmitted from the sewing machine 2 to the information processing device 3 in the main processing (refer to FIG. 2 to FIG. 5). Note that, in the following description, a case is exemplified in which, in the information processing device 3, the OS is not in the sleep state and the application is switched from the state of running in the foreground to a state of running in the background (C001, refer to FIG. 10), and the communication session between the information processing device 3 and the sewing machine 2 has been disconnected (step S411, refer to FIG. 10).

Figure 10:
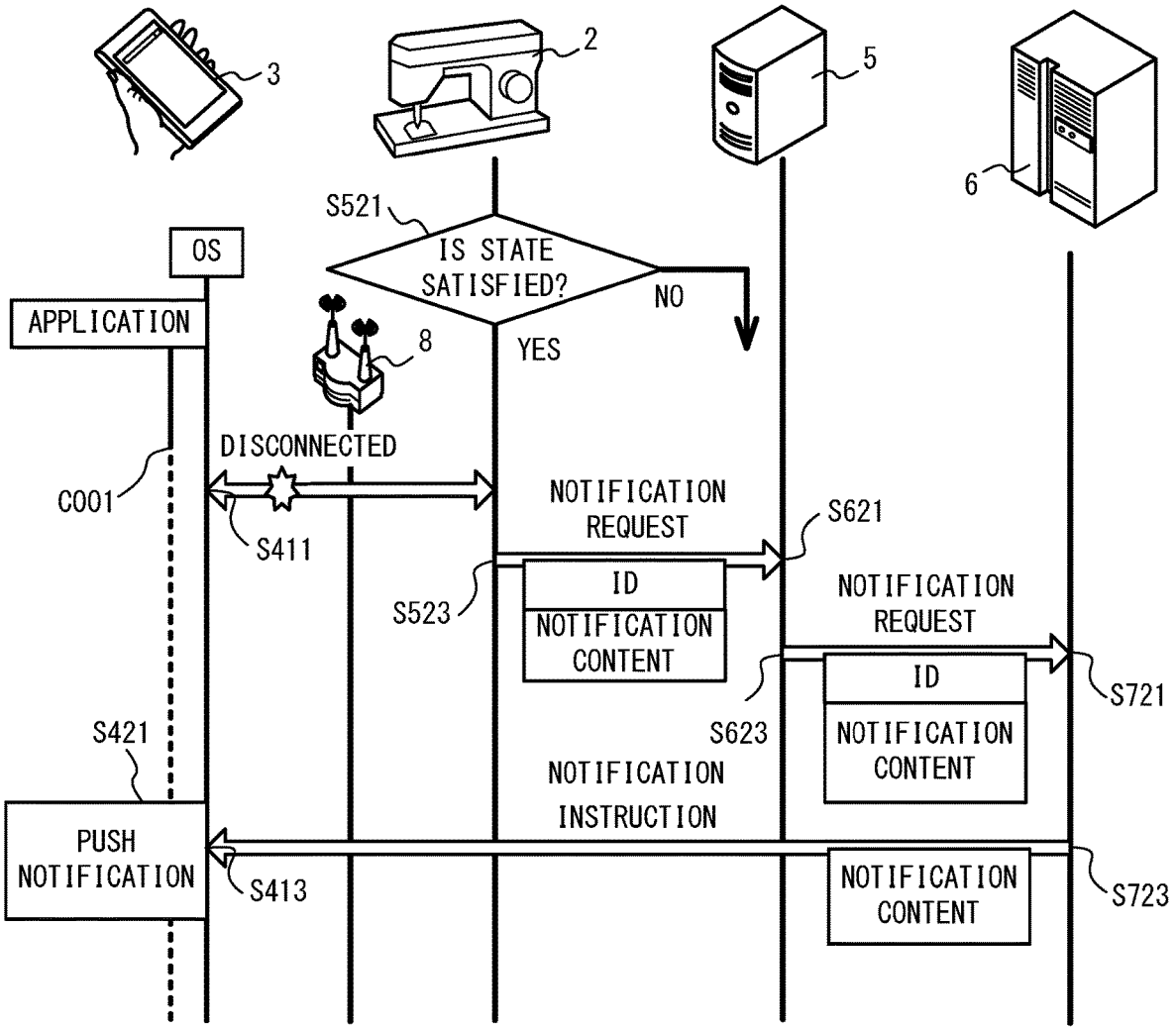
FIG. 10 is a diagram showing a communication sequence of second communication processing (application: background).

As shown in FIG. 10, by performing the main processing (refer to FIG. 2 to FIG. 5), the sewing machine 2 determines to transmit the notification information to the information processing device 3 (yes at step S521). In this case, since the session with the information processing device 3 is disconnected, it is necessary for the sewing machine 2 to cause the information processing device 3 to perform the push notification. The sewing machine 2 transmits a command (referred to as a "notification request") to the server 5 via the LAN 7A and the public network 7B, in order to request the notification instruction to be transmitted from the server 6 to the information processing device 3 (step S523). An ID for identifying the information processing device 3, and notification content information indicating notification content by the push notification are included in the notification request.

The server 5 receives the notification request via the public network 7B (step S621). When the ID that is the same as the ID included in the received notification request is stored in the storage 504, the server 5 transmits the notification request to the server 6 via the public network 7B (step S623). The server 6 receives the notification request via the public network 7B (step S721).

For example, when it is determined that the first notification condition is satisfied (yes at step S37, refer to FIG. 5), the sewing machine 2 transmits, to the server 5 via the LAN 7A and the public network 7B, the notification request that contains the first extent information (step S87 and step S91, refer to FIG. 5), the third extent information (step S99, refer to FIG. 5), the second color information (step S87, refer to FIG. 5), the notice information (step S99, refer to FIG. 5), and the like, as the notification content information (step S523). Further, for example, when it is determined that the second notification condition is satisfied (yes at step S35, refer to FIG. 3), the sewing machine 2 transmits, to the server 5 via the LAN 7A and the public network 7B, the notification request including the second extent information (step S47, refer to FIG. 3) as the notification content information (step S523). For example, when the error is detected (yes at step S31, refer to FIG. 3), the sewing machine 2 transmits, to the server 5 via the LAN 7A and the public network 7B, the notification request including the notification information and the fourth extent information as the notification content information (step S523). The server 5 transmits the received notification request to the server 6 via the public network 7B (step S623).

The server 6 acquires the ID included in the received notification request. The server 6 identifies the information processing device 3 identified by the acquired ID. Furthermore, the server 6 acquires the notification content information included in the notification request. The server 6 transmits, to the information processing device 3 via the public network 7B, the notification instruction for performing the push notification of notification content indicated by the acquired notification content information (step S723). The notification content information is included in the notification instruction. The transmission of the notification instruction including the notification content information from the server 6 to the information processing device 3 is referred to as "the notification content is notified by the push notification".

In response to the notification content being notified by the push notification by the server 6, the information processing device 3 receives the notification instruction via the public network 7B, using a reception function of the OS (hereinafter referred to as an "OS reception function") (step S413). In this case, the information processing device 3 acquires the notification content notified by the push notification, on the basis of the notification content information included in the received notification instruction. Using a display function of the OS (hereinafter referred to as an "OS display function"), the information processing device 3 displays, on the LCD 308, the push notification for notifying the user of the notification content indicated by the acquired notification content information (step S421).

Figure 11:
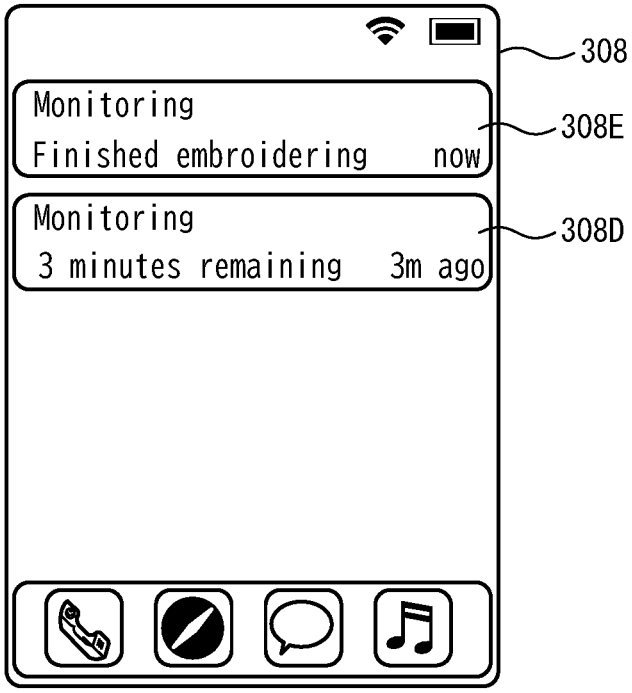
FIG. 11 is a diagram showing a screen displayed on the LCD by the second communication processing.

FIG. 11 shows a screen displayed on the LCD 308 in response that the information processing device 3 has received the first extent information and the second extent information. A message indicating the first remaining time period (three minutes) is included in a push image 308D corresponding to the first extent information. A message indicating that the sewing of the embroidery pattern is complete is included in a push image 308E corresponding to the second extent information.

Note that the first communication processing and the second communication processing are performed in parallel. Thus, for example, when the communication session between the sewing machine 2 and the information processing device 3 is continuing, the sewing machine 2 transmits the first extent information and the second extent information to the information processing device 3 via the path R1 (step S513). On the other hand, for example, when the session between the sewing machine 2 and the information processing device 3 has been disconnected, the sewing machine 2 can transmit the first extent information and the second extent information to the information processing device 3 via the path R2 using the push notification (step S523).

Effects and Operations

The sewing machine 2 sets the first remaining time period (three minutes) as the extent of progress indicating the timing three minutes before the timing of the replacement of the sewing thread in use that is necessary for continuing the sewing. Further, the sewing machine 2 sets the second remaining time period (zero minutes) as the extent of progress indicating the timing of the replacement of the sewing thread in use that is necessary for continuing the sewing. The sewing machine 2 transmits the first extent information to the information processing device 3 at the timing before the timing of the replacement of the sewing thread in use, and transmits the second extent information to the information processing device 3 at the timing of the replacement of the sewing thread in use. Thus, the sewing machine 2 can notify the information processing device 3 in advance of the timing at which the sewing is to be stopped. Thus, the user that recognizes the notification can perform, in advance, an operation necessary before the stopping of the sewing, that is, preparations for the replacement of the sewing thread in use. In this case, the sewing machine 2 can shorten a time required until the sewing of the embroidery pattern is complete.

The sewing machine 2 acquires the first remaining time period input by the user via the operation portion 209 (step S113), and stores the input first remaining time period in the storage 204 (step S115). Further, for example, the sewing machine 2 acquires the second remaining time period input by the user via the operation portion 209 (step S119), and stores the acquired second remaining time period in the storage 204 (step S121). Thus, the user can set the timings at which the sewing machine 2 transmits the first extent information and the second extent information to the information processing device 3 to desired timings.

When the first notification condition is satisfied (yes at step S39), the sewing machine 2 transmits the first extent information indicating the first remaining time period (three minutes) to the information processing device 3 (step S87, step S91), and when the second notification condition is satisfied (yes at step S35), the sewing machine 2 transmits the second extent information indicating the second remaining time period (zero minutes) to the information processing device 3 (step S47). The first remaining time period (three minutes) or the second remaining time period (zero minutes) is displayed on the information processing device 3. Thus, on the basis of the first extent information transmitted from the sewing machine 2 to the information processing device 3, the user can ascertain the remaining time period until the sewing of the embroidery pattern is complete. As a result, the user can appropriately perform the replacement operation of the sewing thread in use that is necessary for continuing the sewing of the embroidery pattern, on the basis of the remaining time period. Further, the user can recognize that the sewing of the embroidery pattern is complete, on the basis of the second extent information transmitted from the sewing machine 2 to the information processing device 3.

The sewing machine 2 can transmit the first extent information to the information processing device 3 for each of the plurality of colors of thread used to perform the sewing. Further, when performing the sewing of the embroidery pattern using the next thread that is different from the sewing thread in use, after sewing the embroidery pattern using the sewing thread in use of the first color (yes at step S83), the sewing machine 2 transmits, to the information processing device 3, the second color information indicating the second color that is the color of the thread to be sewn subsequent to the sewing thread in use, and the first extent information indicating the first remaining time period (three minutes) (step S87). As a result, the sewing machine 2 can cause the user to prepare, in advance, the thread of the second color necessary at the time of the replacement of the sewing thread in use.

When the first notification condition is satisfied during the sewing using the thread of the second color (yes at step S39), and the color of the thread to be sewn subsequent to the sewing thread in use of the second color is not specified (no at step S83, no at step S89), instead of the second color information, the sewing machine 2 transmits, to the information processing device 3, the notice information giving advance notice of the completion of the sewing of the embroidery pattern (step S99). In this case, the user can recognize that the sewing of the whole embroidery pattern is to be completed by the end of the sewing using the thread of the second color. Thus, the user can recognize, in advance, that the replacement operation of the sewing thread in use is not necessary.

When the sewing of the whole embroidery pattern is completed by the end of the sewing using the sewing thread in use of the second color, the sewing machine 2 determines whether the remaining time period satisfies the third notification condition (step S97). The third remaining time period (one minute) indicated by the third notification condition is less than the first remaining time period (three minutes) and is greater than the second remaining time period (zero minutes). When the third notification condition is satisfied, (yes at step S97), instead of the first extent information, the sewing machine 2 transmits, to the information processing device 3, the third extent information indicating the third remaining time period (one minute) (step S99). In this case, the sewing machine 2 can cause a timing at which the user is notified of the third extent information before the completion of the sewing of the whole embroidery pattern to be closer to a timing at which the sewing of the whole embroidery pattern is complete.

When, at the time point at which the sewing using the sewing thread in use of the second color starts, the sewing time is less than the first remaining time period (three minutes) (yes at step S23), the sewing machine 2 does not transmit the first extent information to the information processing device 3 even when the condition to transmit the first extent information is satisfied (no at step S81). In this way, the sewing machine 2 can resolve a failure in which the time until the completion of the sewing from the transmission of the first extent information becomes shorter than the first remaining time period.

When, at the time point that the error occurs, the difference between the remaining time period until the completion of sewing and the first remaining time period (three minutes) is within the predetermined range (yes at step S101), the sewing machine 2 transmits the error notification information and the fourth extent information indicating the remaining time period to the information processing device 3 (step S103). In this case, the user can recognize the occurrence of the error, and the remaining time period until the completion of the sewing.

In response to the transmission request from the information processing device 3, the sewing machine 2 transmits the remaining time period to the information processing device 3 (step S509). Further, regardless of whether or not the transmission request has been received, the sewing machine 2 can transmit the first extent information when the first notification condition is satisfied (step S513), and can transmit the second extent information when the second notification condition is satisfied (step S513).

The sewing machine 2 can transmit the first extent information and the second extent information to the information processing device 3 via the LAN 7A (step S513). Further, the sewing machine 2 can also transmit the first extent information and the second extent information to the information processing device 3 using the push notification via the public network 7B (step S523). Thus, even when the communication via either the LAN 7A or the public network 7B is not possible, the sewing machine 2 can transmit the remaining time period until the completion of the sewing of the embroidery pattern to the information processing device 3.

The sewing machine 2 subtracts the second number of stitches, which is the number of already sewn stitches, from the first number of stitches, which is the total number of stitches required to sew the embroidery pattern, and multiplies the result of the subtraction by the time required per sewing stitch. In this way, the sewing machine 2 calculates, as the extent of progress, the remaining time period until the completion of the sewing of the embroidery pattern (step S29). In this case, the sewing machine 2 can calculate the remaining time period with a high accuracy.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

MODIFIED EXAMPLES

The information processing device 3 may acquire the extent of progress information indicating the remaining time period until the completion of the sewing of the embroidery pattern from the sewing machine 2. On the basis of the remaining time period indicated by the acquired extent of progress information, the information processing device 3 may determine whether each of the first notification condition and the second notification condition is satisfied. The information processing device 3 may output the first remaining time period when the first notification condition is satisfied, and may output the second remaining time period when the second notification condition is satisfied. The programs of the processing performed by the CPU 301, the first notification condition, and the second notification condition may be stored in the storage 304 of the information processing device 3.

Figure 12:
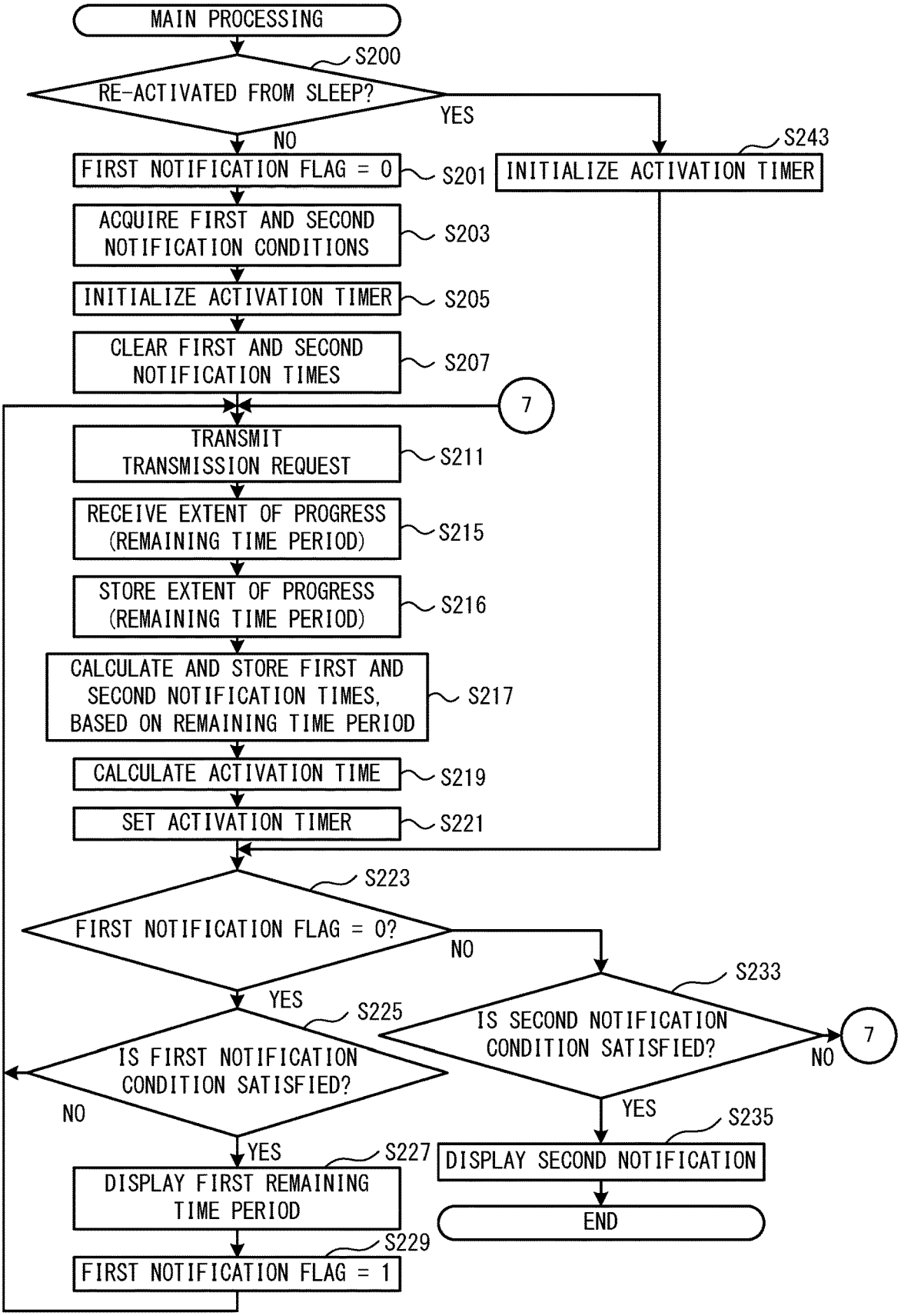
FIG. 12 is a flowchart of main processing according to a first modified example.

Main processing according to a modified example will be described with reference to FIG. 12. When the information processing device 3 receives, via the touch panel 305, a start command to start the application, the information processing device 3 starts the main processing by reading out a program stored in the storage 304 and executing the read program. Note that when the OS transitions to the sleep state in the state in which the application is activated, the functions of the application are stopped. When the functions of the application are stopped by the OS transitioning to the sleep state in this way, the main processing is also started by the OS being re-activated from the sleep state. In the following description, when the OS is not in the sleep state, it is assumed that the application is running in the foreground. Further, it is assumed that the sewing of the embroidery pattern is to be performed using only the thread of one color.

An activation timer to re-activate the OS from the sleep state is provided in the OS. The activation timer can re-activate the OS from the sleep state at a set activation time, and can cause the functions of the application to be executable. Furthermore, a time register indicating a current time is provided in the OS.

When the main processing is started, the information processing device 3 determines whether the main processing has been started as a result of the OS being re-activated from the sleep state (step S200). When it is determined that the main processing has not been started as a result of the OS being re-activated from the sleep state (no at step S200), the information processing device 3 causes the processing to transition to step S201. The information processing device 3 sets a first notification flag stored in the RAM 303 to "0", and performs initialization (step S201). The information processing device 3 reads out and acquires the first notification condition and the second notification condition stored in the storage 304 (step S203). The information processing device 3 initializes the activation time set in the activation timer (step S205). The information processing device 3 initializes a first notification time and a second notification time stored in the RAM 303 (step S207).

Using the App transmission function, the information processing device 3 transmits, to the sewing machine 2, a transmission request that is a command requesting the extent of progress information (step S211). Note that, when the sewing machine 2 receives the transmission request, the sewing machine 2 transmits, to the information processing device 3, the extent of progress information indicating the remaining time period until the completion of the sewing of the embroidery pattern. Using the App reception function, the information processing device 3 receives the extent of progress information transmitted from the sewing machine 2 in response to the transmission request (step S215).

The information processing device 3 stores the remaining time period indicated by the received extent of progress information, as the extent of progress, in the storage 304 (step S216). On the basis of the remaining time period stored in the storage 304 and the current time acquired from the time register, the information processing device 3 calculates a time at which the remaining time period will become the first remaining time period (three minutes) (hereinafter referred to as the "first notification time") (step S217). The information processing device 3 stores the calculated first notification time in the RAM 303 (step S217). On the basis of the remaining time period stored in the storage 304 and the current time acquired from the time register, the information processing device 3 calculates a time at which the remaining time period will become the second remaining time period (zero minutes), that is, the time at which the sewing of the embroidery pattern will be complete (hereinafter referred to as the "second notification time") (step S217). The information processing device 3 stores the calculated second notification time in the RAM 303 (step S217).

On the basis of the first notification time and the second notification time stored in the RAM 303, the information processing device 3 calculates, as the activation times at which the OS is re-activated from the sleep state, each of a time earlier than the time satisfying the first notification condition and a time earlier than the time satisfying the second notification condition (step S219). The times earlier than the times satisfying the first notification condition and the second notification condition are calculated taking into account a time required for performing at least step S211 and step S215 at least one time from when the OS is re-activated from the sleep state. The information processing device 3 sets the calculated activation times in the activation timer (step S221). In this way, even if the OS transitions to the sleep state, the OS is re-activated from the sleep state at least at the times satisfying the first notification condition and the second notification condition, and can be in a state in which the application is executable. The information processing device 3 advances the processing to step S223.

Note that a plurality of the times earlier than the time satisfying the first notification condition, and a plurality of the times earlier than the time satisfying the second notification condition may be respectively calculated as the activation times and may be set in the activation timer. Further, a time later than the current time may be calculated as the first notification time. In this type of case, the information processing device 3 may calculate only a time earlier than the second notification time as the activation time, and set this time in the activation timer, and need not necessarily set a time earlier than the first notification time in the activation timer.

The information processing device 3 determines whether a first notification flag stored in the RAM 303 is set to "0" (step S223). When it is determined that the first notification flag is set to "0" (yes at step S223), the information processing device 3 determines whether the first notification condition is satisfied (step S225). When the current time acquired from the time register has not passed the first notification time stored in the RAM 303, the information processing device 3 determines that the first notification condition is not satisfied (no at step S225). In this case, the information processing device 3 returns the processing to step S211.

When the activation time set in the activation timer is reached in the sleep state, the OS is re-activated from the sleep state. When it is determined that the main processing has been started by the OS being re-activated from the sleep state (yes at step S200), the information processing device 3 initializes the activation time set in the activation timer (step S243). The information processing device 3 advances the processing to step S223.

When it is determined that the first notification flag is set to "0" (yes at step S223), the information processing device 3 determines whether the first notification condition is satisfied (step S225). When the current time acquired from the time register has passed the first notification time stored in the RAM 303, the information processing device 3 determines that the first notification condition is satisfied (yes at step S225). In this case, the remaining time period until the completion of the sewing of the embroidery pattern is equal to or less than the first remaining time period (three minutes). The information processing device 3 displays the first remaining time period (three minutes) on the LCD 308 (step S227). In order to avoid repeatedly determining whether the first notification condition is satisfied or not, the information processing device 3 sets the first notification flag stored in the RAM 303 to "1" (step S229). The information processing device 3 returns the processing to step S211.

After performing the processing at step S211 to step S221, the information processing device 3 determines whether the first notification flag stored in the RAM 303 is set to "0" (step S223). When it is determined that the first notification flag is set to "1" (no at step S223), the information processing device 3 advances the processing to step S233. Thus, after the first remaining time period (three minutes) is once displayed on the LCD 308 (step S227), the determination as to whether the first notification condition is satisfied or not (step S225) is not repeated. The information processing device 3 determines whether the second notification condition is satisfied (step S233). When the current time acquired from the time register has not passed the second notification time stored in the RAM 303, the information processing device 3 determines that the second notification condition is not satisfied (no at step S233). In this case, the information processing device 3 returns the processing to step S211.

After performing the processing at step S211 to step S221, the information processing device 3 determines that the first notification flag is set to "1" (no at step S223). When the current time acquired from the time register has passed the second notification time stored in the RAM 303, the information processing device 3 determines that the second notification condition is satisfied (yes at step S233). In this case, the sewing of the embroidery pattern is complete. The information processing device 3 displays the second remaining time period (zero minutes) on the LCD 308 (step S235). The information processing device 3 ends the main processing.

As described above, in place of the sewing machine 2, the information processing device 3 determines whether the first notification condition and the second notification condition are satisfied (step S225, step S233). Thus, while suppressing a load on the sewing machine 2, the information processing device 3 can notify the user when the remaining time period until the completion of the sewing of the embroidery pattern has reached the first remaining time period (three minutes) and has reached the second remaining time period (zero minutes). Further, even when the OS has transitioned to the sleep state, the information processing device 3 can release the sleep state of the OS, and can notify the user of the first remaining time period and the second remaining time period.

The information processing device 3 may predict the first notification time and the second notification time when information processing device 3 has not been able to receive the extent of progress information from the sewing machine 2. The sewing machine 2 may perform the sewing of the embroidery pattern using the threads of the plurality of colors.

Figure 13:
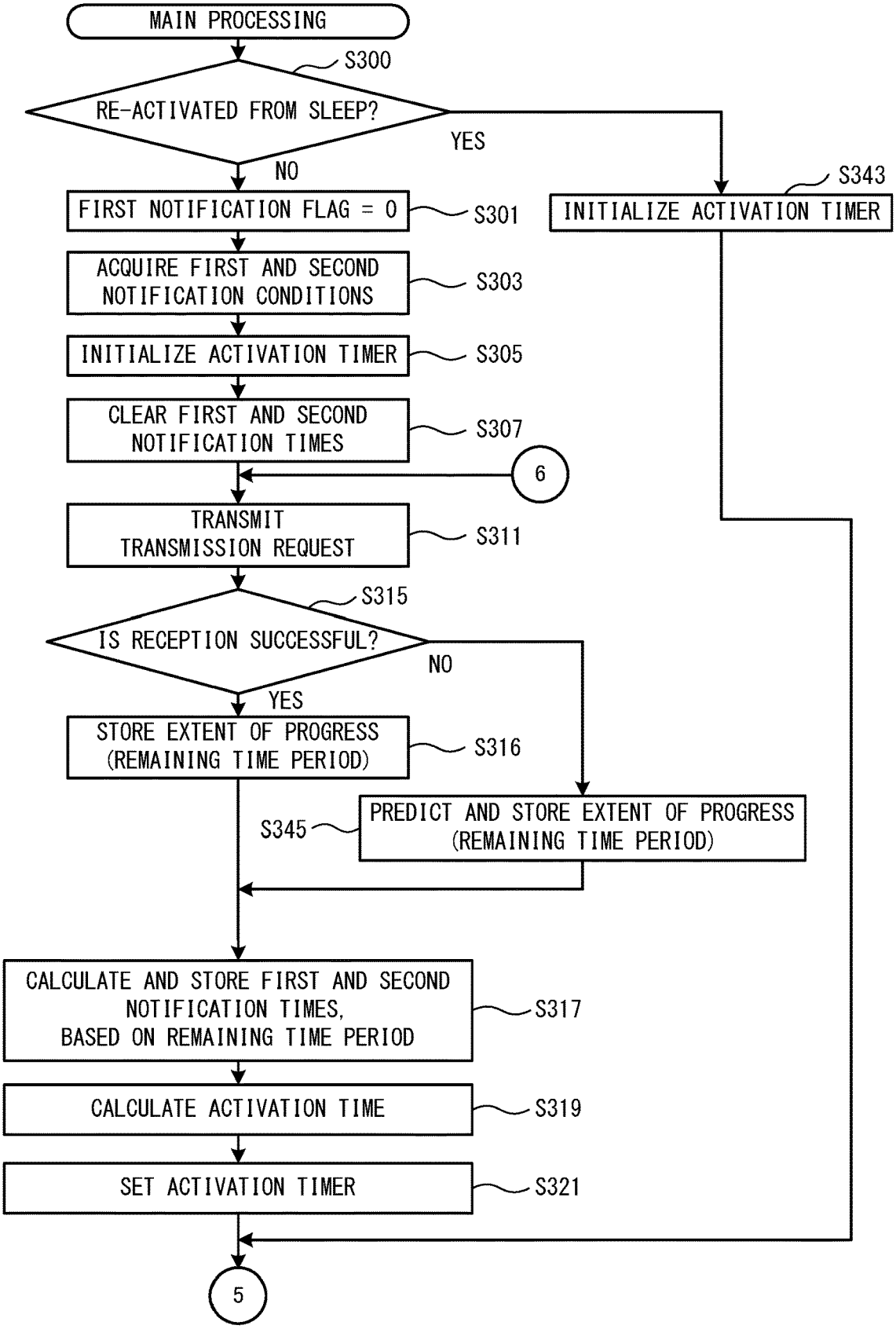
FIG. 13 is a flowchart of the main processing according to a second modified example.

Main processing according to a modified example will be described with reference to FIG. 13 and FIG. 14. As shown in FIG. 13, when the main processing is started, the information processing device 3 determines whether the main processing has been started as a result of the OS being re-activated from the sleep state (step S300). When it is determined that the main processing has not been started as a result of the OS being re-activated from the sleep state (no at step S300), the information processing device 3 causes the processing to transition to step S301. The information processing device 3 sets the first notification flag stored in the RAM 303 to "0", and performs initialization (step S301). The information processing device 3 reads out and acquires the first notification condition and the second notification condition stored in the storage 304 (step S303). The information processing device 3 initializes the activation time set in the activation timer (step S305). The information processing device 3 initializes the first notification time and the second notification time stored in the RAM 303 (step S307).

Using the App transmission function, the information processing device 3 transmits the transmission request to the sewing machine 2 (step S311). The information processing device 3 determines whether the extent of progress information transmitted from the sewing machine 2 in response to the transmission request has been received by the App reception function (step S315). When it is determined that the extent of progress information has been received (yes at step S315), the information processing device 3 acquires the remaining time period indicated by the received extent of progress information, and stores the acquired remaining time period in the storage 304 (step S316). On the basis of the remaining time period stored in the storage 304 and the current time acquired from the time register, the information processing device 3 calculates the first notification time (step S317) and stores the calculated first notification time in the RAM 303 (step S317). On the basis of the remaining time period stored in the storage 304 and the current time acquired from the time register, the information processing device 3 calculates the second notification time (step S317) and stores the calculated second notification time in the RAM 303 (step S317). The information processing device 3 advances the processing to step S319.

The information processing device 3 calculates the activation times corresponding to each of a time earlier than the first notification time stored in the RAM 303, and a time earlier than the second notification time (step S319). The information processing device 3 sets the calculated times in the activation timer (step S321). Note that a plurality of the times earlier than the time satisfying the first notification condition, and a plurality of the times earlier than the time satisfying the second notification condition may be respectively calculated as the activation times and may be set in the activation timer. Further, a time later than the current time may be calculated as the first notification time. In this type of case, the information processing device 3 may calculate only the time earlier than the second notification time as the activation time, and set this time in the activation timer, and need not necessarily set the time earlier than the first notification time in the activation timer. The information processing device 3 advances the processing to step S323 (refer to FIG. 14).

Figure 14:
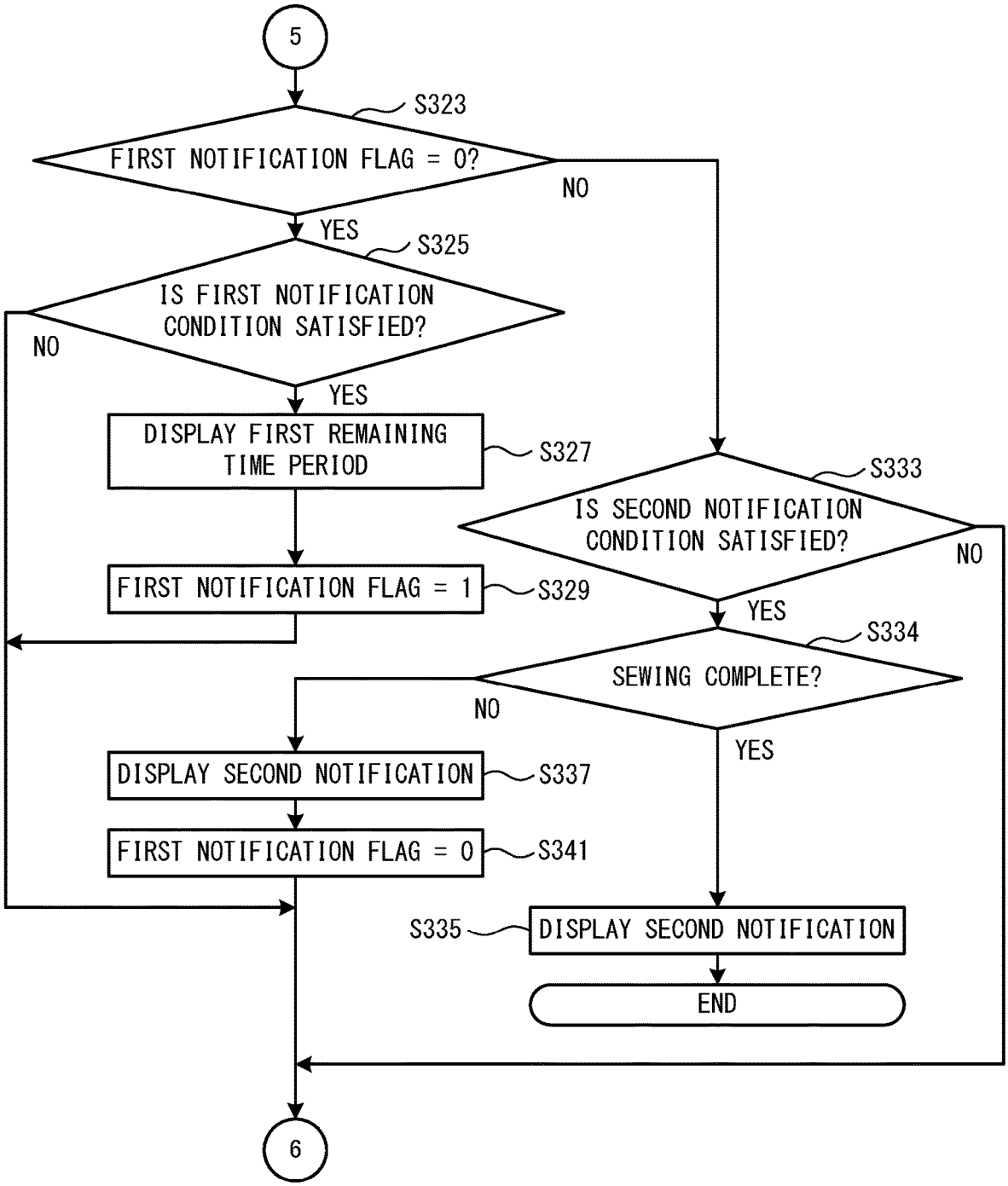
FIG. 14 is a flowchart of the main processing according to the second modified example, and is a continuation of FIG. 13.

As shown in FIG. 14, the information processing device 3 determines whether the first notification flag stored in the RAM 303 is set to "0" (step S323). When it is determined that the first notification flag is set to "0" (yes at step S323), the information processing device 3 determines that the first notification condition is satisfied (step S325). When it is determined that the first notification condition is not satisfied (no at step S325), the information processing device 3 returns the processing to step S311 (refer to FIG. 13).

When the OS in the sleep state reaches the activation time set in the activation timer, the OS is re-activated from the sleep state. When it is determined that the main processing has been started as a result of the OS being re-activated from the sleep state (yes at step S300), the information processing device 3 initializes the activation time set in the activation timer (step S343). The information processing device 3 advances the processing to step S323 (refer to FIG. 14).

Further, after transmitting the transmission request to the sewing machine 2 from the second time onward (step S311), when it is determined that the extent of progress information has not been received (no at step S315), the information processing device 3 advances the processing to step S345. On the basis of the remaining time period indicated by the extent of progress information stored in the storage 304 by the processing at step S316 and on an elapsed time from when the extent of progress information is stored in the storage 304 by the processing at step S316, the information processing device 3 predicts the remaining time period until the completion of the sewing of the embroidery pattern (step S345). For example, when the remaining time period indicated by the extent of progress information stored in the storage 304 is X minutes, and the elapsed time from when the extent of progress information is stored in the storage 304 is Y minutes, the information processing device 3 calculates the time at (X−Y) minutes from the current time, and uses that as the predicted remaining time period until the completion of the sewing of the embroidery pattern. The information processing device 3 stores the predicted remaining time period in the storage 304 (step S345).

The information processing device 3 calculates the first notification time on the basis of the predicted remaining time period (step S317), and stores the calculated first notification time in the RAM 303 (step S317). The information processing device 3 calculates the second notification time on the basis of the predicted remaining time period (step S317), and stores the calculated second notification time in the storage 304 (step S317). The information processing device 3 calculates the activation time (step S319), and sets the calculated activation time in the activation timer (step S321).

As shown in FIG. 14, when it is determined that the first notification flag is set to "0" (yes at step S323), the information processing device 3 determines whether the first notification condition is satisfied (step S325). When the current time acquired from the time register has passed the first notification time stored in the RAM 303, the information processing device 3 determines that the first notification condition is satisfied (yes at step S325). In this case, the remaining time period stored in the storage 304 is less than the first remaining time period (three minutes). The information processing device 3 displays the first extent information indicating the first remaining time period (three minutes) on the LCD 308 (step S327). In order to avoid repeatedly determining whether or not the first notification condition is satisfied, the information processing device 3 sets the first notification flag stored in the RAM 303 to "1" (step S329). The information processing device 3 returns the processing to step S311 (refer to FIG. 13).

After performing the processing from step S311 to step S321 shown in FIG. 13, as shown in FIG. 14, the information processing device 3 determines whether the first notification flag stored in the RAM 303 is set to "0" (step S323). When it is determined that the first notification flag is set to "1" (no at step S323), the information processing device 3 advances the processing to step S333.

The information processing device 3 determines whether the second notification condition is satisfied (step S333).

When the current time acquired from the time register has not passed the second notification time stored in the RAM 303, the information processing device 3 determines that the second notification condition is not satisfied (no at step S333). The information processing device 3 returns the processing to step S311 (refer to FIG. 13).

On the other hand, when the current time acquired from the time register has passed the second notification time stored in the RAM 303, the information processing device 3 determines that the second notification condition is satisfied (yes at step S333). In this case, this indicates that the sewing of the embroidery pattern using the sewing thread in use is complete, or that the re-attachment of the cloth with respect to the embroidery frame is necessary. The information determines whether the sewing of the embroidery pattern is complete (step S334). When, after the sewing of the embroidery pattern using the sewing thread in use, the sewing of the embroidery pattern using the thread of another color is to be performed, or the re-attachment of the cloth is necessary, the information processing device 3 determines that the sewing of the whole embroidery pattern is not complete (no at step S334). The information processing device 3 displays the second extent information indicating the second remaining time period (zero minutes) on the LCD 308 (step S337). The information processing device 3 sets the first notification flag stored in the RAM 303 to "0" (step S341). The information processing device 3 returns the processing to step S311 (refer to FIG. 13).

When, after the sewing of the embroidery pattern using the sewing thread in use, the sewing of the embroidery pattern using the thread of the other color is not to be performed, the information processing device 3 determines that the sewing of the whole embroidery pattern is complete (yes at step S334). In this case, the information processing device 3 displays the second extent information indicating the second remaining time period (zero minutes) on the LCD 308 (step S335). The information processing device 3 ends the main processing.

As described above, even when the information processing device 3 cannot receive the extent of progress information from the sewing machine 2 (no at step S315), the information processing device 3 can predict the remaining time period until the completion of the sewing of the embroidery pattern (step S345). Thus, even when the information processing device 3 cannot receive the extent of progress information from the sewing machine 2, the information processing device 3 can notify the user of the first extent information and the second extent information on the basis of the predicted remaining time period.

The present disclosure is not limited to the above-described embodiment, and various modifications are possible. The information processing device 3 is not limited to being the smartphone, and may be a PC, a tablet PC, a dedicated device provided with the LCD 308, or the like. A configuration may be adopted in which the sewing machine 2 can be directly connected to the public network 7B without passing through the access point 8. The notification system 1 need not necessarily include the server 5. In this case, for example, in order to request the transmission of the notification instruction from the server 6 to the information processing device 3, the sewing machine 2 may directly transmit the notification request to the server 6 via the LAN 7A and the public network 7B. The sewing machine 2 and the information processing device 3 may be directly connected, without passing through the access point 8, using wireless direct (WiFi Direct).

The sewing machine 2 calculates the remaining time period until the sewing is complete, as a parameter indicating the extent of progress of the sewing of the embroidery pattern. The extent of progress may be indicated by another parameter. For example, the extent of progress may be a number of stitches of the sewing of the embroidery pattern that are complete, a ratio of the number of stitches of the sewing of the embroidery pattern that are complete, a time required to sew the embroidery pattern, or the like. In this case, the sewing machine 2 may store, in the storage 204, the number of stitches, the ratio, the time, or the like, both as a first extent for determining whether the first notification condition is satisfied, and as a second extent for determining whether the second notification condition is satisfied.

In the setting processing (refer to FIG. 7), the sewing machine 2 may acquire only the first remaining time period and store the first remaining time period in the storage 204. The second remaining time period may be stored in the storage 204 in advance as a setting value. In the setting processing, the sewing machine 2 may acquire only the second remaining time period and store the second remaining time period in the storage 204. The first remaining time period may be stored in the storage 204 in advance as a setting value. The sewing machine 2 may acquire the first remaining time period and the second remaining time period by performing communication with the information processing device 3, and store the first remaining time period and the second remaining time period in the storage 204. In this case, the user may set the first remaining time period and the second remaining time period in the sewing machine 2 by inputting the first remaining time period and the second remaining time period to the information processing device 3. A configuration may be adopted in which the first remaining time period and the second remaining time period are stored in advance in the storage 204 of the sewing machine 2, and the settings cannot be changed by the user.

The sewing machine 2 may calculate the remaining time period until the completion of the sewing of the embroidery pattern for each of groups including a plurality of colors, and may determine whether the first notification condition and the second notification condition are satisfied, respectively, on the basis of the calculated remaining time period. In this case, for example, on the basis of the remaining time period for the sewing of the embroidery pattern using threads of a plurality of colors included in a first group, when it is determined that the first notification condition is satisfied, the sewing machine 2 may transmit, to the information processing device 3, color information including a plurality of colors included in a second group to be used subsequent to the first group.

When the first notification condition is satisfied during the sewing using the thread of the second color (yes at step S39), and the thread of the color to be sewn subsequent to the sewing thread in use of the second color is not specified (no at step S83, not at step S89), the sewing machine 2 may transmit the notice information as it is to the information processing device 3, without changing the first notification condition to the third notification condition (step S99). Further, the sewing machine 2 may transmit the first extent information to the information processing device 3 in addition to the notice information.

The sewing machine 2 may set a plurality of the third notification conditions when the sewing of the whole embroidery pattern is complete by the ending of the sewing of the second portion using the sewing thread in use of the second color. The sewing machine 2 may transmit the third extent information to the information processing device 3

(step S99) every time each of the plurality of third notification conditions is satisfied (yes at step S97). When, at the time of starting the sewing of the first portion or the second portion of the embroidery pattern using the sewing thread in use of the second color, the sewing time is less than the first remaining time period (three minutes) (yes at step S23), the sewing machine 2 may transmit information indicating the sewing time to the information processing device 3 (no at step S81). The sewing machine 2 need not necessarily perform the processing at step S21, step S23, and step S25. In other words, the sewing machine 2 may transmit the first extent information to the information processing device 3 even when, at the time of starting the sewing of the first portion or the second portion of the embroidery pattern using the sewing thread in use of the second color, the sewing time is less than the first remaining time period (three minutes) (yes at step S23).

When, at the time point at which the error occurs, the difference between the remaining time period until the completion of the sewing and the first remaining time period (three minutes) is within the predetermined range (yes at step S101), in addition to the error notification information and the fourth extent information indicating the remaining time period, the sewing machine 2 may also transmit error type information indicating the type of the error to the information processing device 3 (step S103).

When it is determined that the first notification condition or the second notification condition is satisfied, the sewing machine 2 may store the first extent information or the second extent information in the storage 204 for a fixed time period. When the transmission request transmitted from the information processing device 3 is received within the fixed time period, the sewing machine 2 may transmit, to the information processing device 3, the first extent information or the second extent information stored in the storage 204, and the extent of progress information indicating the remaining time period. In this case, the sewing machine 2 need not necessarily transmit the first extent information to the information processing device 3 even when the first notification condition is satisfied, and need not necessarily transmit the second extent information to the information processing device 3 even when the second notification condition is satisfied.

Even when the application is running in the foreground, when the OS has transitioned to the sleep mode, the information processing device 3 cannot receive the notification information from the sewing machine 2 using the App reception function. In contrast to this, after transmitting the notification information to the information processing device 3 via the LAN 7A, when the sewing machine 2 cannot receive an ACK from the information processing device 3, the sewing machine 2 may transmit the notification information to the information processing device 3 using the push notification via the server 5 and the server 6. Even when the OS is not in the sleep state and the application is running in the foreground, the information processing device 3 may perform the push notification when the notification information is received from the server 6. In this case, the sewing machine 2 may always transmit the notification instruction to the information processing device 3 using the push notification via the servers 5 and 6.

A prediction method when the remaining time period until the completion of the sewing of the embroidery pattern is predicted in the information processing device 3 is not limited to that of the above-described embodiment. For example, the information processing device 3 may acquire, from the sewing machine 2, a start notification transmitted when the sewing machine 2 starts the sewing, and a sewing time required to sew the embroidery pattern. The information processing device 3 may predict the remaining time period by calculating the remaining time period until the completion of the sewing of the embroidery pattern on the basis of an elapsed time from a timing at which the start notification is received, and the sewing time.

In the modified examples, the information processing device 3 need not necessarily perform each of the processing steps for causing the OS to be re-activated from the sleep state (step S205, step S207, step S216, step S217, step S219, step S221, step S305, step S307, step S316, step S317, step S319, step S321, and the like). For example, the information processing device 3 may acquire the first and second notification conditions (step S203, step S303), may transmit the transmission request to the sewing machine 2 (step S211, step S311), and may receive the extent of progress (step S215, step S315). The information processing device 3 may determine whether the received extent of progress satisfies the first notification condition (step S225, step S325), and may display the first remaining time period when the first notification condition is satisfied (step S227, step S327). Further, the information processing device 3 may determine whether the received extent of progress satisfies the second notification condition (step S233, step S333), and may display the second remaining time period when the second notification condition is satisfied (step S235, step S337).

What is claimed is:

1. A sewing machine, comprising:

a sewing portion configured to sew an embroidery pattern based on sewing data;

a communication portion for performing communication with an information processing device;

a processor; and a memory configured to store a plurality of notification conditions for notifying the information processing device of an extent of progress of sewing of the embroidery pattern, the notification conditions including a first notification condition for notifying that the extent of progress is a first extent and a second notification condition for notifying that the extent of progress is a second extent, and to store computer readable instructions that, when executed by the processor, instruct the processor to perform processes comprising:

first acquisition processing of acquiring the sewing data;

second acquisition processing of acquiring the extent of progress, based on sewing information specified by the sewing data acquired by the first acquisition processing;

first determination processing of determining whether the extent of progress acquired by the second acquisition processing satisfies the first notification condition stored in the memory;

first transmission processing of controlling the communication portion and transmitting, to the information processing device, first extent information indicating the first extent, when the first determination processing determines that the first notification condition is satisfied;

second determination processing of determining whether the extent of progress acquired by the second acquisition processing satisfies the second notification condition stored in the memory; and second transmission processing of controlling the communication portion and transmitting, to the information processing device, second extent information indicating the second extent, when the second determination processing determines that the second notification condition is satisfied.

2. The sewing machine according to claim 1, wherein the computer readable instructions stored in the memory further instruct the processor to perform processes comprising:

third acquisition processing of acquiring the first notification condition; and storage processing of storing, in the memory, the first notification condition acquired by the third acquisition processing.

3. The sewing machine according to claim 1, wherein the extent of progress indicates a remaining time period until completion of the sewing of the embroidery pattern, the first notification condition is a condition for notifying that the remaining time period is equal to or less than a predetermined remaining time period, the second acquisition processing includes acquiring the remaining time period as the extent of progress, based on the sewing information, the first determination processing includes determining whether the remaining time period acquired by the second acquisition processing is equal to or less than the predetermined remaining time period, and the first transmission processing includes transmitting, to the information processing device, the first extent information indicating the predetermined remaining time period, when the first determination processing determines that the remaining time period is equal to or less than the predetermined remaining time period.

4. The sewing machine according to claim 1, wherein the embroidery pattern is sewn using threads of a plurality of colors, the sewing data specifies an order for the plurality of colors to be sewn, the second acquisition processing includes acquiring the extent of progress for each of the plurality of colors, based on the sewing information for each of the plurality of colors, the first determination processing includes determining whether the extent of progress for a first color acquired by the second acquisition processing satisfies the first notification condition stored in the memory, and at a time of sewing using a thread of the first color, when the first determination processing determines that the first notification condition is satisfied, the first transmission processing includes transmitting, to the information processing device, second color information and the first extent information, the second color information indicating a second color specified, in the sewing data, to be sewn subsequent in order to the first color.

5. The sewing machine according to claim 4, wherein at the time of sewing using the thread of the first color, when the first determination processing determines that the first notification condition is satisfied and the color of the thread to be sewn subsequent to the thread of the first color is specified, the first transmission processing includes transmitting the second color information and the first extent information to the information processing device, and at the time of sewing using the thread of the first color, when the first determination processing determines that the first notification condition is satisfied and the color of the thread to be sewn subsequent to the thread of the first color is not specified, the first transmission processing includes transmitting, to the information processing device, notice information giving notice of completion of the sewing of the embroidery pattern, and transmitting the first extent information to the information processing device.

6. The sewing machine according to claim 5, wherein the computer readable instructions stored in the memory further instruct the processor to perform a process comprising:

third determination processing of determining whether a third notification condition for notifying a third extent greater than the first extent and less than the second extent is satisfied, and the first transmission processing includes transmitting, to the information processing device, third extent information indicating the third extent, in place of the first extent information, when the first determination processing determines that the first notification condition is satisfied and the third determination processing determines that the third notification condition is satisfied.

7. The sewing machine according to claim 5, wherein the extent of progress indicates a remaining time period until completion of the sewing per color, for each of the plurality of colors, the first notification condition is a condition for notifying that the remaining time period is equal to or less than a predetermined remaining time period, the computer readable instructions stored in the memory further instruct the processor to perform processes comprising:

calculation processing of calculating a sewing time when the embroidery pattern is to be sewn using the thread of the second color; and fourth determination processing of determining whether the sewing time calculated by the calculation processing is less than the predetermined remaining time period, at a start of sewing using the thread of the second color, when the fourth determination processing determines that the sewing time is equal to or greater than the predetermined remaining time period, and the first determination processing determines that the first notification condition is satisfied, the first transmission processing includes transmitting the first extent information to the information processing device, and at the start of sewing using the thread of the second color, when the fourth determination processing determines that the sewing time is less than the predetermined remaining time period and the first determination processing determines that the first notification condition is satisfied, the first transmission processing does not include transmitting the first extent information to the information processing device.

8. The sewing machine according to claim 5, wherein the extent of progress indicates a remaining time period until completion of the sewing of the embroidery pattern, the first notification condition is a condition for notifying that the remaining time period is equal to or less than a predetermined remaining time period, and the computer readable instructions stored in the memory further instruct the processor to perform processes comprising:

detection processing of detecting occurrence of a sewing abnormality;

fifth determination processing of determining whether a difference between the remaining time period acquired as the extent of progress by the second acquisition processing when the detection processing detects the sewing abnormality and the predetermined remaining time period is within a predetermined range; and third transmission processing of transmitting, to the information processing device, when the fifth determination processing determines that the difference is within the predetermined range, notification information notifying the occurrence of the sewing abnormality, and fourth extent information indicating the remaining time period acquired by the second acquisition processing.

9. The sewing machine according to claim 1, wherein the computer readable instructions stored in the memory further instruct the processor to perform processes comprising:

reception processing of receiving a transmission request, transmitted from the information processing device, requesting transmission of the extent of progress; and fourth transmission processing of transmitting the extent of progress to the information processing device in response to receiving the transmission request by the reception processing, the first transmission processing includes transmitting the first extent information to the information processing device when the first notification condition is determined to be satisfied, regardless of whether the transmission request is received by the reception processing, and the second transmission processing includes transmitting the second extent information to the information processing device when the second notification condition is determined to be satisfied, regardless of whether the transmission request is received by the reception processing.

10. The sewing machine according to claim 9, wherein the communication portion includes a first communication function for performing communication via a public network, and a second communication function for performing communication via a LAN, the first transmission processing includes transmitting the first extent information to a push notification server via the public network, using the first communication function, and transmitting the first extent information to the information processing device from the push notification server that has received the first extent information, as a result of the first extent information being notified by push notification via the public network, the second transmission processing includes transmitting the second extent information to the push notification server via the public network, using the second communication function, and transmitting the second extent information to the information processing device from the push notification server that has received the second extent information, as a result of the second extent information being notified by push notification via the public network, the reception processing includes receiving the transmission request from the information processing device via the LAN, using the second communication function, and the fourth transmission processing includes transmitting the extent of progress to the information processing device via the LAN.

11. The sewing machine according to claim 1, wherein the sewing information specified based on the sewing data acquired by the first acquisition processing is information of a number of stitches, and the second acquisition processing includes acquiring the extent of progress based on a first number of stitches, which is the information of the number of stitches, indicating a total number of the number of stitches required to sew the embroidery pattern, and a second number of stitches, which is the information of the number of stitches, indicating the number of stitches already sewn or the number of stitches remaining until completion of the sewing of the embroidery pattern.

12. A non-transitory computer readable storage medium storing computer readable instructions that, when executed by a processor, cause the processor to perform processes comprising:

acquisition processing of acquiring an extent of progress of sewing of an embroidery pattern, the extent of progress indicating a remaining time period until completion of the sewing of the embroidery pattern;

first determination processing of determining whether a first notification condition for notifying that the extent of progress acquired by the acquisition processing is a first extent is satisfied, the first notification condition being a condition for notifying that the remaining time period is equal to or less than a predetermined remaining time period, the first determination processing including determining whether the remaining time period acquired by the acquisition processing is equal to or less than the predetermined remaining time period;

first output processing of outputting first extent information indicating the first extent, when the first determination processing determines that the first notification condition is satisfied, the first output processing including outputting the first extent information indicating the predetermined remaining time period, when the first determination processing determines that the remaining time period is equal to or less than the predetermined remaining time period;

second determination processing of determining whether a second notification condition for notifying that the extent of progress acquired by the acquisition processing is a second extent is satisfied; and second output processing of outputting second extent information indicating the second extent, when the second determination processing determines that the second notification condition is satisfied.

13. A non-transitory computer readable storage medium storing computer readable instructions that, when executed by a processor, cause the processor to perform processes comprising:

first transmission processing of transmitting, to a sewing machine, a transmission request requesting transmission of an extent of progress of sewing of an embroidery pattern;

first determination processing of determining whether the extent of progress transmitted from the sewing machine in response to the transmission request transmitted by the first transmission processing is received;

storage processing of storing the received extent of progress in a memory, when the first determination processing determines that the extent of progress is received;

prediction processing of, when the first determination processing determines that the extent of progress is not received, predicting the extent of progress based on the extent of progress stored in the memory and an elapsed time period from a time point of storing the extent of progress in the memory;

second determination processing of determining whether a first notification condition for notifying that the extent of progress predicted by the prediction processing is a first extent is satisfied;

first output processing of outputting first extent information indicating the first extent, when the second determination processing determines that the first notification condition is satisfied;

third determination processing of determining whether a second notification condition for notifying that the extent of progress predicted by the prediction processing is a second extent is satisfied; and second output processing of outputting second extent information indicating the second extent, when the third determination processing determines that the second notification condition is satisfied.

* * * * *